US009828755B1

(12) United States Patent
Clements

(10) Patent No.: US 9,828,755 B1
(45) Date of Patent: Nov. 28, 2017

(54) TOUCH FREE AUTOMATIC BIDET

(71) Applicant: Sigmund Lindsay Clements, Montreal (CA)

(72) Inventor: Sigmund Lindsay Clements, Montreal (CA)

( * ) Notice: Subject to any disclaimer, the term of this patent is extended or adjusted under 35 U.S.C. 154(b) by 666 days.

(21) Appl. No.: 14/312,697

(22) Filed: Jun. 24, 2014

(51) Int. Cl.
*E03D 9/08* (2006.01)
*E03D 5/10* (2006.01)

(52) U.S. Cl.
CPC ..... *E03D 9/08* (2013.01); *E03D 5/105* (2013.01)

(58) Field of Classification Search
CPC ..... E03D 5/10; E03D 5/105; E03D 9/08
USPC ..... 700/283
See application file for complete search history.

(56) References Cited

U.S. PATENT DOCUMENTS 4,598,431 A * 7/1986 Nagai ..... E03D 9/08 4/420.2
4,692,951 A * 9/1987 Taki ..... E03D 5/10 4/209 R
4,903,347 A * 2/1990 Garcia ..... E03D 9/08 4/420.4
5,201,080 A * 4/1993 Tanaka ..... E03D 9/08 4/443
7,753,885 B2 4/1993 Tanaka
6,098,211 A * 8/2000 Ehrensperger ..... A47K 17/00 4/233
6,317,717 B1 * 11/2001 Lindsey ..... E03C 1/055 137/559
6,754,912 B1 * 6/2004 Hayashi ..... E03D 9/08 239/468
8,321,968 B2 * 12/2012 Park ..... E03D 9/08 4/443
9,538,304 B1 * 1/2017 Millikin ..... H04R 29/00
2002/0007510 A1 * 1/2002 Mann ..... E03C 1/057 4/300
2002/0134777 A1 * 9/2002 Nonomura ..... E03D 9/08 219/494
2003/0140407 A1 * 7/2003 Matsumoto ..... E03D 9/08 4/420.4
2005/0027208 A1 * 2/2005 Shiraishi ..... E03D 9/08 600/551

(Continued)

OTHER PUBLICATIONS

U.S. Appl. No. 14/258,013, sigmund clements.

(Continued)

*Primary Examiner* — Christopher Harmon

(57) ABSTRACT

An automatic bidet automatically washes a user, after they have eliminated, while sitting on a toilet. The bidet uses a camera connected to a computer, to identify a user's gender, and to identify elimination from the users front or back location, the information is used direct water to the user's elimination positions, after eliminating. When washing the user, an automatic water aiming device, can also be used, to automatically target and direct water, to the user's elimination positions, without the user, having to move their body, to the water stream. A bottom air drier automatically dries the user's bottom, after washing. The automatic bidet decreases the transmission, of possibly harmful bacteria and viruses, to the user, by relieving them of manually having to operate, a possibly bacteria contaminated bidet control panel. Bidet automation frees the user, from expending effort, and needing knowledge to operate a bidet.

14 Claims, 14 Drawing Sheets

(56) References Cited

U.S. PATENT DOCUMENTS

| | | | | |
|---|---|---|---|---|
| 2007/0081696 | A1* | 4/2007 | Brennan | G07C 9/00158 382/115 |
| 2007/0266488 | A1* | 11/2007 | Jeon | E03D 9/08 4/443 |
| 2011/0153101 | A1* | 6/2011 | Thomas | G06Q 10/04 700/291 |
| 2013/0019271 | A1* | 1/2013 | Chiu | E03D 5/10 725/80 |
| 2013/0138229 | A1* | 5/2013 | Mizuura | G05B 11/01 700/83 |
| 2014/0200737 | A1* | 7/2014 | Lortz | B60R 25/25 701/1 |
| 2014/0358258 | A1* | 12/2014 | Fangsheng | G05B 15/02 700/90 |
| 2015/0000025 | A1 | 1/2015 | Clements | |
| 2015/0000026 | A1 | 1/2015 | Clements | |
| 2015/0059076 | A1 | 3/2015 | Tiagai | |

OTHER PUBLICATIONS

U.S. Appl. No. 14/512,359, sigmund clements.
U.S. Appl. No. 14/556,144, sigmund clements.
U.S. Appl. No. 14/585,187, sigmund clements.
U.S. Appl. No. 14/634,788, sigmund clements.
U.S. Appl. No. 14/791,895, sigmund clements.

* cited by examiner

TOUCH FREE AUTOMATIC BIDET

CROSS REFERENCE TO RELATED APPLICATIONS

This application claims the benefit of provisional patent applications, Ser. Nos. 61/954,567 filed 2014 Mar. 17, 61/946,789 filed 2014 Mar. 1, 61/922,755 filed 2013 Dec. 31, 61/916,298 filed 2013 Dec. 16, 61/912,024 filed 2013 Dec. 5, 61/910,299 2013 Nov. 30, 61/896,117 filed 2013 Oct. 27, 61/890,186 filed 2013 Oct. 12, 61/889,167 2013 Oct. 10. This application claims the benefit of patent applications, Ser. No. 13/928,378 filed 2013 Jun. 27, Ser. No. 13/927,111, filed 2013 Jun. 26, and Ser. No. 14/258,013 2014 filed Apr. 22, by the present applicant.

FEDERALLY SPONSORED RESEARCH

Not Applicable

SEQUENCE LISTING

None

BACK GROUND FIELD

This application relates to toilet bidets, specifically to electronic bidets, and bidet control panel displays.

BACK GROUND

Electronic toilet bidets, refer to devices that are mounted on a toilet, usually located at the back of the toilet bowel. The bidet enable a user to wash a female's front, and female or males back, elimination positions. The bidet uses water streamed on to a user's body elimination positions, after elimination. Bidets are more sanitary to use, than using toilet paper, for cleaning. Bidets have an additional variety of functions.

Bidet cleaning wands extend beneath the users posterior. Water jets, streams of water, are emitted and directed at the posterior, which washes the posterior and the female vulva. The bidet is an apparatus that can adjust the ejecting position of water, or area of the bidet nozzle spray, by adjusting the wand nozzle position, the water pressure can be adjusted. Wands can move oscillate back and forth, and rotate side to side, to change the direction of the water stream.

As electronic bidets have evolved, the addition of more devices have been incorporated in the bidet, with the addition of more devices, the functions that the bidet does has increased. More bidet devices have been added increased functionality to the bidet. Bidet devices, such as, water aeration, dual cleaning wands as shown in Ku NI toilets or Satis toilet washlets made by Toto of Tokyo, Japan.

An electronic bidet may comprise single or dual shower wands, with directional ward movement for directing water spray emitted from the wand's nozzles. Remote or attached bidet control panels, can be used for operating various bidet devices, such as, a water heater for temperature control, a water aerator, a bottom air dryer to dry a user after wash, an air deodorizer spray strength, a seat massager, a seat heater, a radio, an automatic flush touch free seat and lid positioning, etc.

The bidet affords senior citizens and those suffering from debilitating illness, such as arthritis, a hands-free bathroom experience that can provide independence and restore dignity. Cleansing for the whole family, while the feminine wash offers multiple benefits, leaving them shower fresh after each use. Sanitary washing apparatuses can clean the human private parts by washing with water. Hence, sanitary washing apparatuses are rapidly becoming popular.

The bidet has been widely installed and used in bathrooms of homes and in restrooms of large buildings or in places frequented by many people. The bidet is a fixture that washes a user's genital and anal areas using washing water sprayed through the nozzle tip. The tip which is fused to a nozzle and is moved into and out of a bidet body, thus obviating the need to use toilet paper after defecating. The water remaining on the genital and anal areas can be removed, using warm air supplied by a drier. The bidet nozzle has a water discharge port, the nozzle is configured to wash a human private part by squirting water from the water discharge port.

Toilet remote control panels, such as, a Satis toilet remote control touch screen display that is made by the Lixil toilet company of Tokyo, Japan, a Kohler Numi toilet remote control touch screen display made by the Kohler Company of Kohler, Wis., or a Toto smart toilet remote control touch screen display made by Toto Company of Tokyo, Japan. The screen needs to be touched to activate the toilet devices. The screen may have bacteria on it that can be transferred to a user when they touch the screen.

Several Satis toilets made by the Lixil Corporation of Tokyo, Japan, use a smart phone Bluetooth connection to Satis smart toilet, a touch screen display is used to activate a user's toilet device operation profile. Smart phone toilet icon buttons are used to change the user's profile. Physical touch is needed to activate the buttons. Thought a person could have their own private cell phone to operate the toilet, the user still has to physically touch the buttons. The touching of the buttons may be a path way for bacterial transmission. Active input is needed by the user operate a toilet control panel; passive user input won't operate the system.

Wireless Bluetooth remote control, liquid crystal display panel are used to influence a toilet devices functions, such as, a toilet remote control touch screen display and toilet made by the Kohler Company. The Brondell Company of San Francisco, Calif., uses a hand held remote control which uses an infrared connection, to a smart toilet seat bidet, to control the toilet seats bidet functions. The remote screen needs to be touched to activate the user's profile. The screen may have bacteria on it, that can be, transferred to a user when they touch the screen.

Through the functionality of bidets has increased. The users input interface with the bidet control panel has developed more slowly. Bidet users touch buttons, which activate a variety of bidet devices. Active input is, needed by the user, to control the bidet devices.

Some bidets use a preprogrammed user profiles, such as the Numi bidet toilet. The user profile contains the user's preferred bidet device settings. The user profile enable the user to activate, their desired toilet device settings with one touch activation, of the user profile button. The user profile changes the devices setting, without having to enter the settings for each device, every time the bidet is used.

Some examples of user toilet and bidet settings include, water temperature, water stream strength, water pressure, water aeration, water spray back and forth oscillation, water massage pressure, radio station setting, toilet seat temperature, displayed web pages, lid and seat position backwash or front wash, air dryer temperature, air dryer airflow.

The user's preferred device settings may include devices, such as, a bidet single or dual shower wands, with directional ward movement for directing water spray, a water heater for temperature control, a water aerator, bottom air dryer to dry a user after wash, air deodorizer spray strength, seat massager, a seat heater, a radio, an automatic flushing device, and a touch free seat and lid positioning device.

Detection of user's identity can be used to activate pre-set bidet settings which are associated with the user. Detecting a user identity, may include, facial recognition, etc. The pre-set setting may be included in a user profile. Using a user's identity, to activate settings, reduces the input needed, to operate the bidet. As advances in bidet technology increase, bidet automation increases, and user bidet operation input load decreases. Further increases in bidet automation, are still needed, to further reduce the input load, needed to operate a bidet Though the user profile pre-sets the device settings, the user still needs to activate individual devices and control their operation. Devices that are activated by the user's input, may include, activating the posterior wash, activating the front wash, activating the bottom air dryer, etc.

Details of how the various devices operate include, dedicated buttons on a control panel corresponding to various toilet devices, for example, pressing the bottom wash button The wand nozzle extending beneath the user posterior, and a stream of water is emitted, directed at the posterior, which washes the posterior. The bidet may use a second wand nozzle, which extends beneath the user's front, and a stream of water is emitted, directed at the front, which washes the front. Adjustments to the wash spay, are made by touching adjustment buttons on the panel, the bidet wand can move backward forth, or rotate side to side, which increases the water's cleaning area. The nozzles water stream can pulsate, which can massage the back and or front of a user. A bottom air dryer, can blow air out of the bidet, from the back of the toilet bowel, in the direction of the user's posterior. The bottom air dryer, also drying the user's front.

Many of the touch panel toilet device function buttons, heretofore known suffer from a number of disadvantages:

DISADVANTAGES

All of the electronic bidets heretofore known suffer from a number of disadvantages:

(a) Bacteria and viruses may be transmitted to a user's hands, by the user needing to touch bidet control panel buttons, buttons which may have bacteria and viruses on them.

(b) A user may have to understand, how to operate a bidet's control buttons.

(c), Users may fall of the toilet seat as they shift their balance or lean, to operate bidet control panel buttons. Elderly and users who have balance difficulties, may be particularity susceptible to balance problems while operating panel buttons.

(d) Peoples thoughts may be interrupted, by needing to interact with the bidet control panel.

(e) Care takers of patients, may have to help a patient use the bidet control buttons.

(f) Users may have to learn, and understand how to operate the bidet control buttons.

(g) Physically challenged users may have a difficulty touching, the control panel buttons.

(h) It may be difficult for the user to access the area, where the control panel is located, in order to touch the panel's buttons.

(i) It may be difficult to clean and remove bacteria from mechanical input buttons, and bacteria may build up on the buttons.

(j) A user may worry about, what was on the hands of a user, that operated a bidet control panel before them (k) Users may worry about, touching bacteria and viruses on a bidet control panel.

Hands free operation of bidets is needed to reduce, bacteria and viruses being transferred to a user's fingers and hands various devices can be used for non-touch bacterial free operation of the bidet, such as, voice recognition, mid-air hand gesture recognition, eye movement recognition, etc. These touch free input devices aid in reducing bacterial transmission. Though a bidet which further reduce bacterial transmission is needed.

SUMMARY

Accordingly several advantages are to provide an improved automatic bidet, as a means of providing a more sanitary, fun, and healthy experience, for a person. Still further advantages will become apparent, from a study of the following description and the accompanying drawings. Various embodiments of the automatic bidet, allow for a user to activate the various toilet devices, by using the toilet, without the need to touch a control panel display. The capabilities and functions of a touch free automatic bidet, bring the future of sanitary bathroom practices and advances, to the present now.

The automatic bidet automatically washes a user's bottom as they are sitting on a toilet seat. User information gathered from cameras and sensors, inside and outside of the toilet, is sent to the bidet's computer. A computer software is used to determine, the user's gender, bowel and bladder evacuation positions, and starting and stopping of elimination. With gender, evacuation position, and starting and stopping of elimination information, the bidet is able to wash the female bladder opening, and or bowel opening, or male bowel opening. Only the input of the user, sitting on and using the toilet, is needed to operate the bidet.

The bidet also uses an automatic water directing device to, automatically direct streams of water the user's elimination positions, without the need for the user to move their body to the stream of water. Automatically directing water to a user's elimination points, positions is beneficial, to users of differing sizes, and users who position themselves differently on a toilet seat. As with the automatic directing of water, the automatic directing of dry air to the user washed eliminations positions, is used to dry the user's front and or back elimination positions.

Some advantages of automatic bidet use, are bacteria and viruses, are unable to be transmitted to the user's hands, from the control panel. By limiting hand contact, with the bacteria and viruses that are on the panel, the transmission of bacteria and viruses to the hands, is substantially reduced. The touch free toilet assembly lowers the amount of bacteria that is transmitted from the toilet to hands.

Lowering the amount of bacteria on the hands, lowers the amount of bacteria that can be transmitted from the hands to the user's mouth. By lowering the quantity of bacteria on the user's hands, lowers the amount of bacteria that can be transmitted from the hands to food. Automatic bidet use limits the bacteria on hands, which limits the amount of bacterial transmitted from hands to surfaces, and from hands to other people. Lowering the cross contamination of bacteria and viruses, from the control panel the user's hands, lessens peoples exposure to food poisoning, and disease pathogens.

Service sectors that are highly concerned about hygiene, such as the food industry, restaurants, medical industry, and hospitals. Health workers, may benefit from hands free bidets. Bidets that use water to clean a user's bottom, a warm air dryer to dry the user's bottom, greatly reduces the need to use toilet paper, which may reduce the amount of bacteria, the user to may be in contact with.

Signs asking employees to wash their hand after going to the toilet, may be less pressing, since workers contact with the toilet control panel, is greatly reduced. Progress in toilet panel cleanliness increases people's psychical wellbeing, and mental wellbeing, by having a safer bathroom environment. Users don't have to worry about, touching bacteria on a bidet control panel. Decreasing sickness caused by bacterial contamination a control panel, increases productivity, and work space contentment.

Automatic bidets are especially helpful to: people who are recovering from surgery; people who have physical disabilities, people with dexterity or other problems that limit their range of motion; people who have various medical conditions, such as hemorrhoids, diarrhea, dysentery, difficult bowel movements, or other ailments that involve the rectal or genital areas. Physically challenged users can access the toilet, without having to touch bidet control buttons. Bidets are helpful to people who have developmental disabilities, such as, mentally challenged users, autism, or cerebral palsy. Bidets can be used by men and women who want better hygiene, before or after sexual activities; and women who want more effective feminine hygiene, during monthly menstrual periods.

Health benefits by using an automatic bidet, include the prevention of female urinary tract infections, by removing bacteria from around the urethra. Hemorrhoid suffers and anal fissure suffers, may benefit, for from bidets cleaning their posterior, with streams of water. Arthritis sufferers are helped by bidets, by removing the need for user to move their hands, to clean with toilet paper, after toilet use. Cleaning with toilet paper which may irate the posterior, more than cleaning with water. The bidet cleans more bowel and bladder elimination material, then by cleaning with toilet paper. Bidets can save trees, by reducing the amount of toilet paper used, during toilet use. Bidets mainly use water, to clean a user.

ADVANTAGES

The advantages of the touch free automatic bidet, include, without limitation, are an improved electronic bidet. From the ensuing description, a number of advantages of some of the embodiments, of the automatic bidet become evident.

The automatic bidet has the additional advantages in that:

(a) Bacteria and viruses are prevented from being transmitted to a user's hands, from a bidet's control panel's buttons. By removing the need for a user, to touch the bidet control panels buttons, which may have bacteria and viruses, on them.

(b) People who are mentally challenged, may have the bidet, automatically wash them, without having to activate, a bidet control panel buttons.

(c) Users don't have to spend time, pressing bidet control panel buttons, they only need to have the bidet wash them. Users can spend less time pressing bidet control buttons, and more time doing other things.

(d) Users conserve mental energy, not having to choose and decide, which of the various bidet buttons, to activate.

(e) The automatic bidet, helps prevent people from falling off the toilet. People don't have to shift their balance, or lean their body, to press bidet buttons. The lack of needed body motion, is useful for users, with balance issues and elderly users, etc.

(f) People can think of other things, beside what bidet panel buttons, to push, the users thoughts aren't interrupted, by interacting with the bidet.

(g) The automatic bidet can wash, medical patients, without the help of care takers. Care takers can also be assured, patients has been thoroughly and sanitarily washed, by the bidet.

(h) Users don't have to understand or learn how to operate a bidet's operating buttons, the automatic bidet operates without the need to activate bidet buttons.

(i) Care takers can have medical patients, washed by the automatic bidet, without the care taker's need, to operate the bidet.

(j) The bidet can be operated by users without knowledge of the bidet operation. This may be useful for public restrooms, such as hospitals, airports and hotels, etc.

(k) The user only needs to let the system automatically identify their gender and body evacuation processes, to operate the various bidet devices; no other input is needed from the user.

(l) User's don't have to worry about, what was on another user's hands that operated the bidet control panel before them.

(m) User's don't have to worry about touching bacteria and viruses on a bidet control panel.

Several advantages of one or more aspects are to provide a safer, more sanitary and user friendly automatic bidet. Other advantages of one or more aspects are to provide an easier to use automatic bidet. These and other advantages of one or more aspects will become apparent from the ensuing description and accompanying drawings.

DRAWINGS—FIGURES

The drawings, closely related figures may have the same number but different alphabetic suffixes.

REFERENCE NUMBERS

Figure 1:
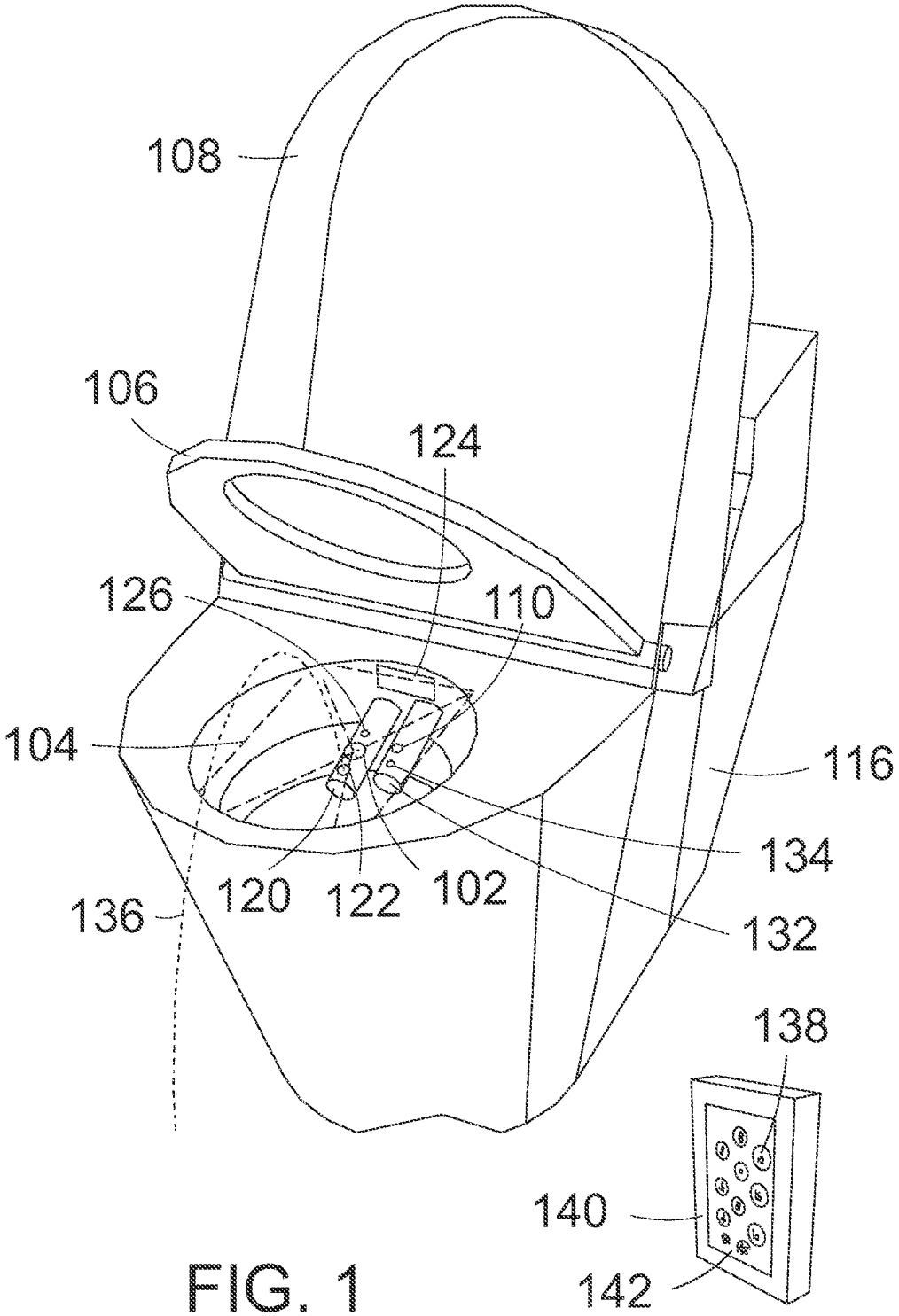
FIG. 1 shows a perspective view of an automatic bidet, incorporated into a toilet and a bidet remote control.

102 camera automatic bidet
104 camera and sensor viewing area
106 toilet seat
108 lid
110 sensor
116 toilet
120 front cleaning wand
122 front cleaning wand nozzle
124 bottom air drier
126 light
132 back wash wand
134 back wash wand water nozzle
136 water stream
138 input icon
140 remote with computer
142 remote display
202 camera
204 facial view of user
206 seat
208 bidet
214 display
216 toilet
218 user
220 front wash wand
222 camera
226 remote control panel and computer
228 touch input icon
230 back wash wand
242 microphone
244 speaker
302 camera
306 toilet seat
312 toilet seat lid
316 toilet
320 front cleaning wand
324 bottom air drier
338 bidet assembly
340 remote
342 remote display
502 facial recognition camera
504 facial view of user
508 bidet
514 display
516 toilet
518 user
520 cleaning wand
522 genital recognition camera
526 remote
528 touch input icon
602 sensor
604 sensor
616 toilet
620 wand
624 light
630 wand
640 remote
702 bidet
706 toilet seat
708 nozzle front wash wand
716 toilet
720 nozzle back wash wand
722 front wash wand
724 bottom air drier
726 light
730 sensor
736 back wash wand
738 input icon
740 remote
742 display
746 water stream
752 camera
802 bidet
806 toilet seat
808 nozzle front wash wand
816 toilet
822 front wash wand
824 bottom air drier
826 light
828 bottom air drier
830 sensor
836 back wash wand
838 input icon
840 remote
842 display
846 water stream
852 camera
1402 microphone
1404 microphone
1406 microphone
1408 microphone
1410 toilet within computer in housing
1412 remote toilet control
1414 wand
1416 genital recognition camera
1418 water nozzle
1420 air drying nozzle
1422 bidet
1424 toilet bowel water
1426 side of toilet bowel
1428 water nozzle
1430 wand First Embodiment An Automatic Bidet Description An automatic bidet is used to automatically wash, direct a fluid, stream water or deliver water a user's elimination positions, after they eliminate, while sitting on a toilet 416, as shown in FIG. 1. The automatic bidet, connects to a computer, which analyses user data gathered by a camera and a sensor 410, which are connected to a computer, to 402 detect a user's female or male gender. The computer also detects the user's elimination positions, and the starting and stopping of elimination, from the user's elimination position.

The information collected about the user, is used by the bidet's computer, to direct a stream of water 36 to the user's elimination positions, after the user has eliminated. The stream of water, washes the user's elimination positions. The elimination positions are dried, by a bottom air drier 124, after the washing.

The computer has a processor, the processor is programmed with a software. The processor has a connection to a storage. The computer is used processing data, and for storing data.

User information, data, can be, detected imaging devices, such as, one camera and one sensor. The user data collecting devices could use more than one camera and one sensor. The camera and sensor are used to detect the user's gender. The computer uses a gender detecting software, for determining a user's gender. The determined female or male gender t allows the computer to instruct the bidet, to stream water to the female user's front and or back elimination position, and to stream water to the male user's back elimination position.

An elimination detecting imaging device, using the camera and sensor, is connected to the computer. The computer uses an elimination detecting software. The elimination detecting imaging devices determines, that the user is eliminating.

A starting of elimination detecting imaging device, using the camera and sensor, is connected to the computer. The computer uses is an elimination starting detecting software, to detect the user's start of elimination.

An elimination stoppage detecting imaging device, using the camera and sensor, is connected to the computer. The elimination stoppage detecting imaging device, detects the stopping of the user's elimination, while the user is sitting on a toilet. The detection of the stoppage of elimination, allows for the starting of the streaming water, to the users elimination position, after elimination has stopped.

A position of elimination detecting device, using the camera and sensor, is connected to the computer. The computer uses an elimination position detecting software, for determining the female user's front and or back position of elimination position, and for determining the back male elimination position. The elimination position information allows the computer to stream water to position which was eliminated from.

The bidet is attached to a toilet 416, as shown in FIG. 1. The computer is connected to a motor controller. The motor controller (not shown) is connected to the bidet. The computer and motor controller are housed inside the smart toilet's housing 116. The computer is a lap top computer. The computer could also be a smart phone computer, a tablet computer, a portable or a desk top computer, etc. The automatic bidet is powered by a connection to an alternating current electrical power supply. The computer and motor controller could also be part of the bidet.

The camera and sensor can be a ultrasound sensor, an infrared camera, or a laser sensor, etc., detects when the user emits urine, fluids, form their bladder opening, urethra, vulva, epithelial duct, pelvic floor, female genital, front elimination position, or fecal material, excrement, solid material from their bowel, back elimination position anus, rectum, orifice, alimentary canal, perianal, bottom, buttocks, and posterior, in FIG. 1.

The computer is programmed with a bidet operating software, used for operating the bidet. The computer and computer software, analyses information from the sensors and cameras. The analysed information is used for detecting a user's body elimination positions, for searching for male genitalia, or for searching for female genital, or for searching for the absence of male genital. The computer analyses detected information, concerning the stopping and starting of elimination, the user's gender, and the position of elimination.

The computer uses the analysed information, to direct the bidet motor controller, to supply power to the bidet's devices. The computer instructs the motor controller, to supply power to various devices, to operator the bidet device or devices, such as, supplying power to the front cleaning wand, and or power to the camera, etc.

The genital recognition software could be facial recognition software adapted for the recognition of genitalia. Genital recognition is used to determine the user's gender. Gender genital recognition software, can be created by adapting facial gender recognition, such as, Intel facial gender recognition software and Intel's Software Developers Kit, or using Microsoft Kinect software developers Kit, etc. The user's genital image can be compared to a profile of female, or male genitalia. A stored data base of male and or female genitalia, can be used to find a match with female or male genitalia. If the genital's match a male genital profile then the user is male. If the genital's match a female genital profile, then the user is female.

When the female gender is detected, the computer can instruct the bidet to direct the water stream 136, to either the front or back elimination position, or both positions, of the female user. When the male gender, is detected the computer can instruct the bidet, to direct the water stream to only the male's back elimination position. The detected female and male genders are used to not allow the washing the male user's front elimination position.

If the system is unable to determine the user's gender, the system can ask the user to touch input their gender, using the remote. If the user doesn't input their gender when queried, the bidet will wash both front and back elimination positions, if elimination is detected from those positions.

The computer is programmed with users front and back elimination position recognition software. Elimination from the users front elimination position is liquid urine. Elimination from the user's back elimination position is fecal matter. Elimination detected from the front area of the toilet is assumed to be urine, eliminated from the front elimination position. Elimination detected from the back area of the toilet is assumed to be fecal matter, eliminated from the back elimination position.

A male user's urine front position would not be washed, while the back position would be washed when elimination was detected from the back position. The female's front and backed positions would be washed, when elimination was detected from the positions.

The computer is programmed genital recognition software, elimination starting and stopping detecting software, position of elimination detecting software. The computer 140 is programmed, camera and sensor operating software, with bidet operating software, with bidet wand positioning software. The computer 140 is programmed bidet system operating software and with computer operating software.

The Use of Cameras and Sensors with the Automatic Bidet

The camera and the sensor are used for imagining of the user's, and front and or back position of elimination, for imagining a user's genitals to detect the user's gender, and for imagining the start or stoppage of elimination, as shown in FIG. 1. The camera and sensor gather image data, of the user, while they are sitting on the toilet seat. The camera and sensor's viewing area is the area 104 inside the toilet bowel, which includes the user's genitals and posterior that covering the top of the bowel when the user is sitting on the toilet seat. The camera and the sensor, are the gender recognition imagine detection device. The camera and the sensor, are genital imagine gender recognition sensors. The camera and the sensor, act as female and male gender recognition imagining devices.

The gender detecting information is used for, washing the female's front and back elimination position, and washing the male's back elimination position, and not washing the male front elimination position. The position of elimination information is used to wash the position where elimination has been evacuated from. The stopping and starting of elimination information is used for starting the bidet water stream, when the elimination process is finished. If the camera detects elimination, the computer doesn't start the washing water stream, until the user has finished eliminating.

The camera, and sensor remain on, in a low power mode, to continuously detect if a user, has occupied the seat. The camera, and sensor detect when a user occupied the toilet seat. A pressure switch (not shown) is connected to the computer, and is used to detect when a user on the seat. The switch is activated, by the weight of the user, on the seat. When the user vacates the seat, the camera, sensor and pressure switch detect the user's vacation of the seat, and turn off the bidet.

The camera can use two dimensional 2D, and or three dimensional 3D imaging of the user. The cameras software, is programmed into the computer. Three dimensional cameras which can be used, include, an Intel real sense camera, and software, a Kinect technology camera sensor made by the PrimeSense company, a Cambord Pico made by the Optoma Company of Watford, United Kingdom, a Kinect camera made by the Microsoft company, a XTR3D camera made by the Creative Reality company, of Herzelia, Israel.

The sensor 402 is used for imaging the user's posterior front and back elimination positions can be a, Epileptic Labs ultrasonic 3D sensor Epileptic Labs software, made by the Epileptic Labs Company of Sweden. The sensor software, is programmed into the computer Other three dimensional sensors could be used, such as, a Leap sensor, a Kinect technology camera sensor, a Haptix gesture recognition chip, a Primesense sensor 410, made by the Primesense Company of Israel, a Flutter gesture recognition system, a Infineon 3D Image Sensor IRS10x0C, and Samsung's Galaxy S4 infrared sensor, etc.

The user imaging device could also be and ultrasonic sensors, imaging sensors, imaging devices, an infrared camera, an air sonar sensor, a laser imaging sensor LIDAR, and microphones.

The sensor can be used for three dimensional (3D) imagining, of the user's front and back elimination positions. The sensor is attached to a bidet cleaning wand 432. The sensor uses genital recognition software, to detect the user's gender. The sensor can be used to image, a user's elimination positions.

When a female gender is detected, the computer can instruct the bidet to direct the water stream 436, to either the front or back elimination position or both positions, of the female user. When a male gender is detected the computer can instruct the bidet, to direct the water stream to only the male back elimination position, of the male user.

The camera and sensor are used for detecting, the stopping of elimination, from the female elimination positions, and male elimination positions, as illustrated in FIG. 1. The camera and sensor act as elimination imaging devices. The camera and sensor detect when elimination has started.

The camera 402 and sensor, are used for detecting the user's elimination position. The camera 402 and sensor detect the female front elimination position, and the female back elimination position, and the male back elimination position. The detected info is used for directing a stream of water from the bidet to the female back and front elimination positions, and male back elimination position, after the user has used the toilet.

The sensor and camera are attached to the cleaning wands 132, of the bidet. The sensor and camera connect to the computer. The camera 102 and sensor 110 connect to the motor controller.

The sensor, the camera lens 102 and the wands 120, 132, are cleaned, with streams of water, after each use of the toilet by the user. The wands automatically clean themselves, after each use, by retracting into the bidet, where they are flushed with water. The camera and the camera lens 102, are waterproof. The wands can also be automatically sterilized, after each use, using silver nano particles to wash the nozzles. The wands extends for next use, after they are cleaned.

The camera 102 can use infrared, or ambient light for imagining the user's elimination positions. A light 126 is in the bidet, lights the user's bottom. The camera can use infrared or visual light, to image the user.

The Use of the Remote with the Automatic Bidet

A bidet remote control display panel can be used to operate, activate and deactivate the bidet devices. The remote, can be a portable computer, a tablet computer, or a smart phone computer. The remote control has a touch screen display 142. The remote has a bidet input display panel. The display is used to input commands to the bidet. The remote connects wirelessly, to the bidet. A computer is part of the remote. The remote computer communicates with the bidet computer. The remote computer could act as the primary computer for the bidet. The remote has a speaker and microphone.

The remote can be used, to manually activate, the bidets devices. By touching a menu, of differing bidet device icons 138, associated with different functions of the bidet. The touching of a displayed bidet device function, on the touch input display with a user's fingers, activates the device function associated with the icon. The remote can control and operate the bidet devices, such as, the start and stop of the front bidet wash and backwash, and the turning on and off of the bottom air drier, the water temperature, the water pressure, a toilet seat heater changing the water spay pattern, radio, and internet connection for surfing the web, etc.

The user can view a clock, which counts down the time, till the next process starts or stops. The user can touch input the display, to change cleaning actions or times. The user can touch input, to stop or start, the start of the cleaning process, etc. The user can use touch input, to change the cleaning wait times, cleaning start time, cleaning cycle times, and dryer times, etc.

The remote 140 can connect to the bidet 124, by a Bluetooth wireless connection, a WIFI network connection or a wired connection (not show). The remote 140 is power by a connection to an alternating current, or by the, in phone, direct current battery. The user can override the automatic bidet and operate the bidet manually using the bidet touch control panel.

The user can use the remote to pre-set device settings, such as, increasing water temperature, decreasing the water pressure, changing the water streaming time period, changing the amount of time until the wash cycle activates, etc.

The toilet can be used without the user using the remote control. The remote can be used to input the pre-set bidet settings. The user can use the bidet with the pre-set settings.

A sensor detects when the user is sitting on the toilet seat. When the user is detected sitting on the toilet the bidet activates the automatic bidet. The bidet turns off any time the user vacates the toilet seat.

The Use of the Cleaning Wands with the Automatic Bidet

The bidet is connected to the computer, for allowing the computer to instruct the bidet to stream water for a predetermined amount of time to the female user's back front and or back elimination position, and for streaming water for the predetermined amount of time to the male user's back elimination position. A toilet seat 106 and toilet seat lid 108 are connected to the toilet.

One wand is used to wash the back elimination position, and the other wand is used to wash the female front elimination position. The camera and sensor are incorporated in the cleaning wands of the bidet. The sensor and camera connects to the computer.

The bidet uses two cleaning wands 120, 132 to stream water. The wand 120 with the camera streams water to the user's front position. The wand 132 with the sensor 110, and light, streams water to the user's back position. The bidet could also be a bidet with one cleaning wand to streams water to both elimination positions. The light 126 in the cleaning wand 132, illuminates the user's front and back elimination positions.

The bidet wands 120, 132 are attached to a bidet. The wands rotate, extend, and retracts, to direct and aim, streams of water emanating from water spray nozzles 122, 134 in the wand. The water is streamed to the user's elimination position. The bidet wands 120, 132 are attached to motors or linear actuators (not shown). The motors or linear actuators can move the wands from right to left, can pivot them left or right, rotate them clockwise or counter clockwise, and move them up and down in relations to the bidet. The wands 120, 132 can extend, and retract into the bidet. The water pressure can be increased, or decreased to change the direction of the water stream. The wands can move, to direct a water stream to the user's front and back elimination positions. The wands movements are directed by the computer.

The water pressure can be increased, or decreased to change the direction of the water stream. The wands can be moved by the user, using the control panel, to direct a water stream to the user's front and back elimination positions. The toilet connects to a standard water supply (not shown). The toilet bidet connects to the water supply.

Air blowing nozzles (not shown) near the cameras and senor, are attached to the wands, and blow off any water or fecal matter that may obstruct their view, while they are streaming water. If more cleaning of the cameras and senor is need, the wands will retract into the bidet, where they can be flushed and cleaned with water. After the cleaning the wands, they will extend, and proceed with washing the user's elimination positions. The air drier nozzle dry's the cameras and senor after they have been washed.

The device may further include on-board data storage, such as memory coupled to the processor. The memory may store software that can be accessed and executed by the processor, for example. The host may be any type of computing device or transmitter including a laptop computer, a smart phone, etc., that is configured to transmit data to the device. The host and the device may contain hardware to enable the communication link, such as processors, transmitters, receivers, antennas, etc.

In FIG. 1, the communication link is illustrated as a wired connection, however wireless connections may also be used. For example, the communication link may be a wired link via a serial bus such as USB, or a parallel bus. A wired connection may be a proprietary connection as well. The communication link may also be a wireless connection, such as Bluetooth, IEEE 802.11 (IEEE 802.11 may refer to IEEE 802.11-2007, IEEE 802.11n-2009, or any other IEEE 802.11 revision), or other wireless based communication links. In another example, the system includes an access point through which the device may communicate with the internet. In this example, the device may not require connectivity to the host. The access point may take various forms. For example, if the device connects using 802.11 or via an Ethernet connection, the access point may take the form of a wireless access point (WAP) or wireless router. As another example, if the device connects using a cellular air-interface protocol, such as a CDMA or GSM protocol, the access point may be a base station in a cellular network that provides Internet connectivity via the cellular network. As such, the device may include a wired or wireless network interface through which the device can connect to the access point. As an example, the device may be configured to connect to access point using one or more protocols such as 802.11, 802.16 (WiMAX), LTE, GSM, GPRS, CDMA, EV-DO, and/or HSPDA, among others. Furthermore, the device may be configured to connect to access point using multiple wired and/or wireless protocols, such as "3G" or "4G" data connectivity using a cellular communication protocol (e.g., CDMA, GSM, or WiMAX, as well as for "Wi-Fi" connectivity using 802.11). Other examples are also possible. Alternatively, the host may also include connectivity to the internet, and thus, the device may access the internet through the host.

In addition, for the method and other processes and methods disclosed herein, the flowchart shows functionality and operation of one possible implementation of present embodiments. In this regard, each block may represent a module, a segment, or a portion of program code, which includes one or more instructions executable by a processor for implementing specific logical functions or steps in the process. The program code may be stored on any type of computer readable medium, for example, such as a storage device including a disk or hard drive. The computer readable medium may include non-transitory computer readable medium, for example, such as computer-readable media that stores data for short periods of time like register memory, processor cache and Random Access Memory (RAM). The computer readable medium may also include non-transitory media, such as secondary or persistent long term storage, like read only memory (ROM), optical or magnetic disks, compact-disc read only memory (CD-ROM), for example. The computer readable media may also be any other volatile or non-volatile storage systems. The computer readable medium may be considered a computer readable storage medium, for example, or a tangible storage device. The display 104 shows toilet functions icons, such as, lid up 122, seat up 120, seat down 122, seat and lid down 118, and users profile activation icons 123.

A Kinect for Windows software developer's kit or Microsoft Robotics Developers Kit can be used to program the computer 106 for the Kinect sensor 102. An Intel perceptual computing software developer's kit could be used to build applications for the automatic bidet. The Microsoft Software Developers Kit can be used to build automatic bidet function applications. Various programming languages can used to program the computer 106 such as C++, C#, and Microsoft Visual Studio Ultimate, FAAST key mapping software, Microsoft Visual Programming Language, Microsoft NET 4.0 XNA 4.0, Silverlight 4.0, and Visual Basic.NET. The Microsoft Software Developer's Kit allows developers to write Kinect applications in C++/CLI, C#, Microsoft Visual Programming Language, or Visual Basic .NET. The Microsoft Robotics Developers Studio application contains a graphical environment, Microsoft Visual Programming Language: (VPL) command line tools which may allow a developer to deal with Visual Studio projects (VS Express version) by possibly using C#, and 3D simulation tools.

The computer 106 may be programmed using, Intel software developers kit, the Microsoft windows commercial software development kit, or Linux operating system, or Android operating system. Or Blackberry operating system, or apple operating system. Computer program code for carrying out operations of the object detection and selection mechanism may be written in any combination of one or more programming languages, including an object oriented programming language such as Java, Smalltalk, C++ or the like and conventional procedural programming languages, such as the "C" programming language or similar programming languages. The program code may execute entirely on the computer, partly on the computer, as a stand-alone software package, partly on the computer and partly on a remote computer or entirely on the remote computer or server. In the latter scenario, the remote computer may be connected to the computer through any type of network, including a local area network (LAN) or a wide area network (WAN), or the connection may be made to an external computer (for example, through the Internet using an Internet Service Provider).

Figure 12:
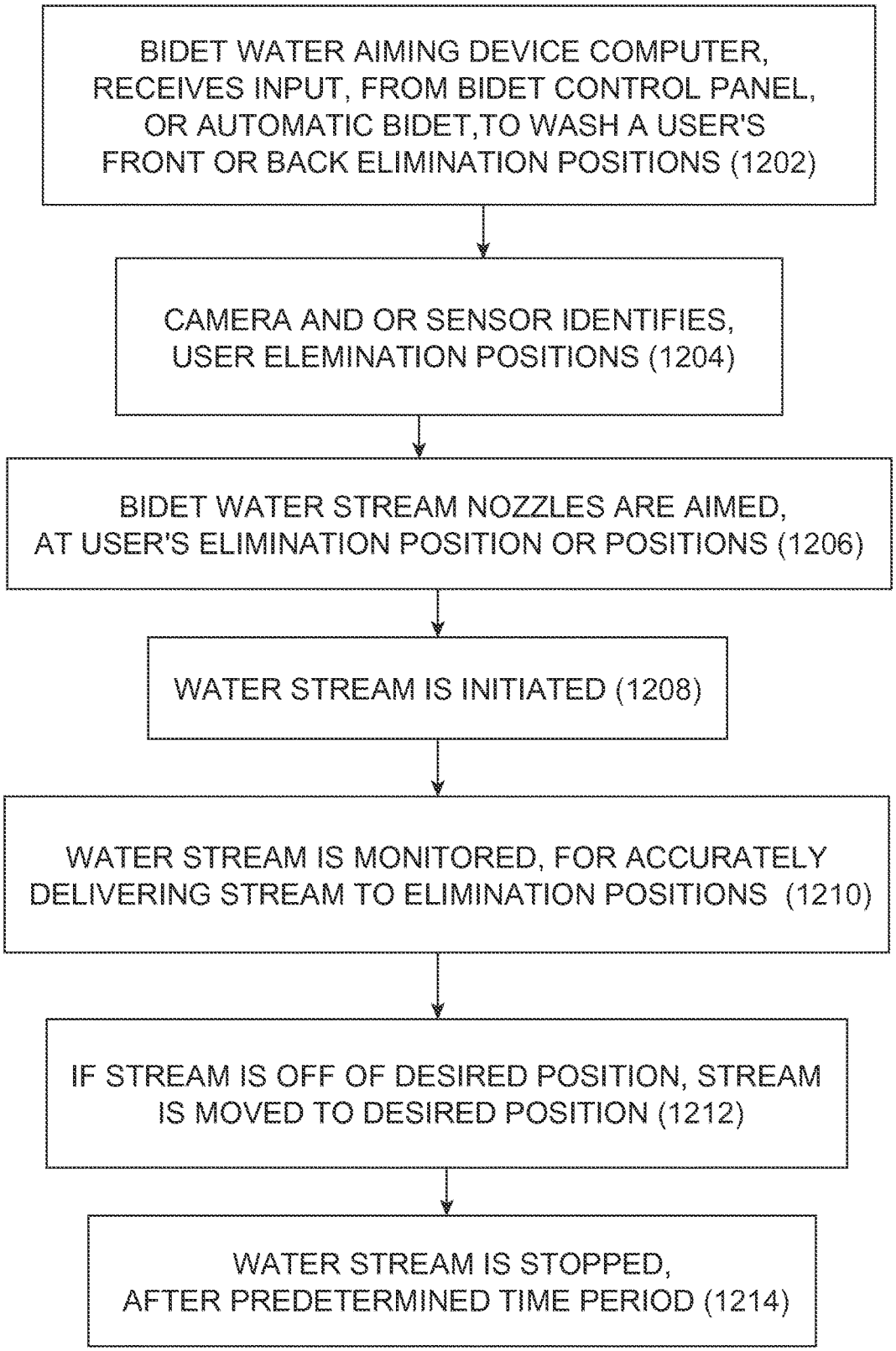
FIG. 12 is a flowchart illustrating a method of operating an automatic water aiming washing device.

The object detection and selection mechanism is described below with reference to flowchart illustrations and or block diagrams of methods, apparatus (systems) and computer program products according to implementations thereof. It will be understood that each block of the flowchart illustrations, FIGS. 10 and 12, and or block diagrams, and combinations of blocks in the flowchart illustrations and/or block diagrams, can be implemented or supported by computer program instructions. These computer program instructions may be provided to a processor of a general purpose computer, special purpose computer, or other programmable data processing apparatus to produce a machine, such that the instructions, which execute via the processor of the computer or other programmable data processing apparatus, create means for implementing the functions/acts specified in the flowchart and/or block diagram block or blocks. In the device software and operation flowchart the following steps of the automatic bidet, and automatic water aiming device operation, as shown in FIGS. 10 and 12.

The computer program instructions may also be loaded onto a computer or other programmable data processing apparatus, to cause a series of operational steps to be performed on the computer 106, or other programmable apparatus to produce a computer implemented process, such that, the instructions which execute on the computer 106, or other programmable apparatus provide processes, for implementing the functions or acts specified, in the flowchart and or block diagram block or blocks.

Figure 9:
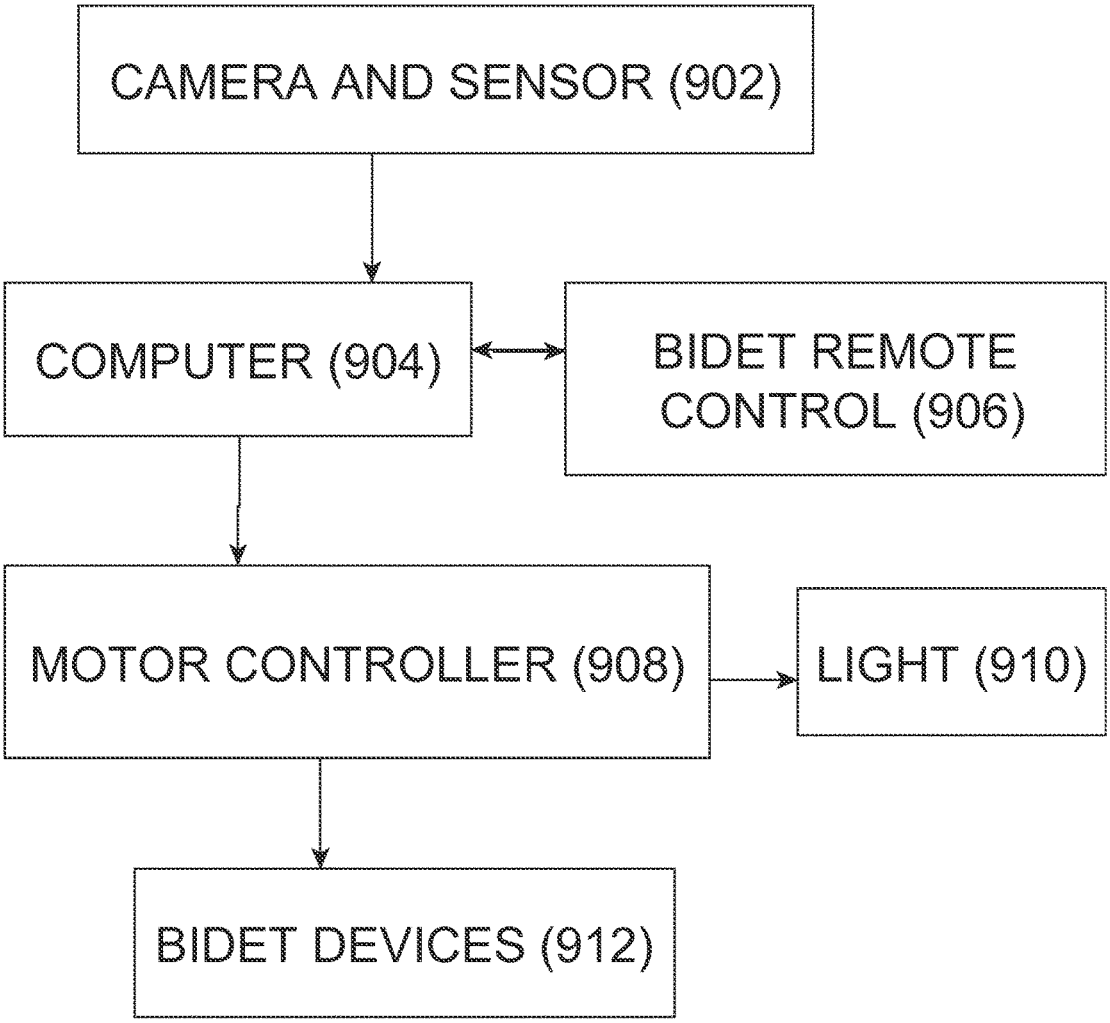
FIG. 9 shows a block diagram, showing the connection of components of an automatic bidet.

FIG. 9 shows a block diagram of showing the connection of components of an automatic bidet. Bidet components may include, camera and or sensor 902, computer 904, bidet remote control 906, motor controller 908, and bidet devices 912.

Figure 10:
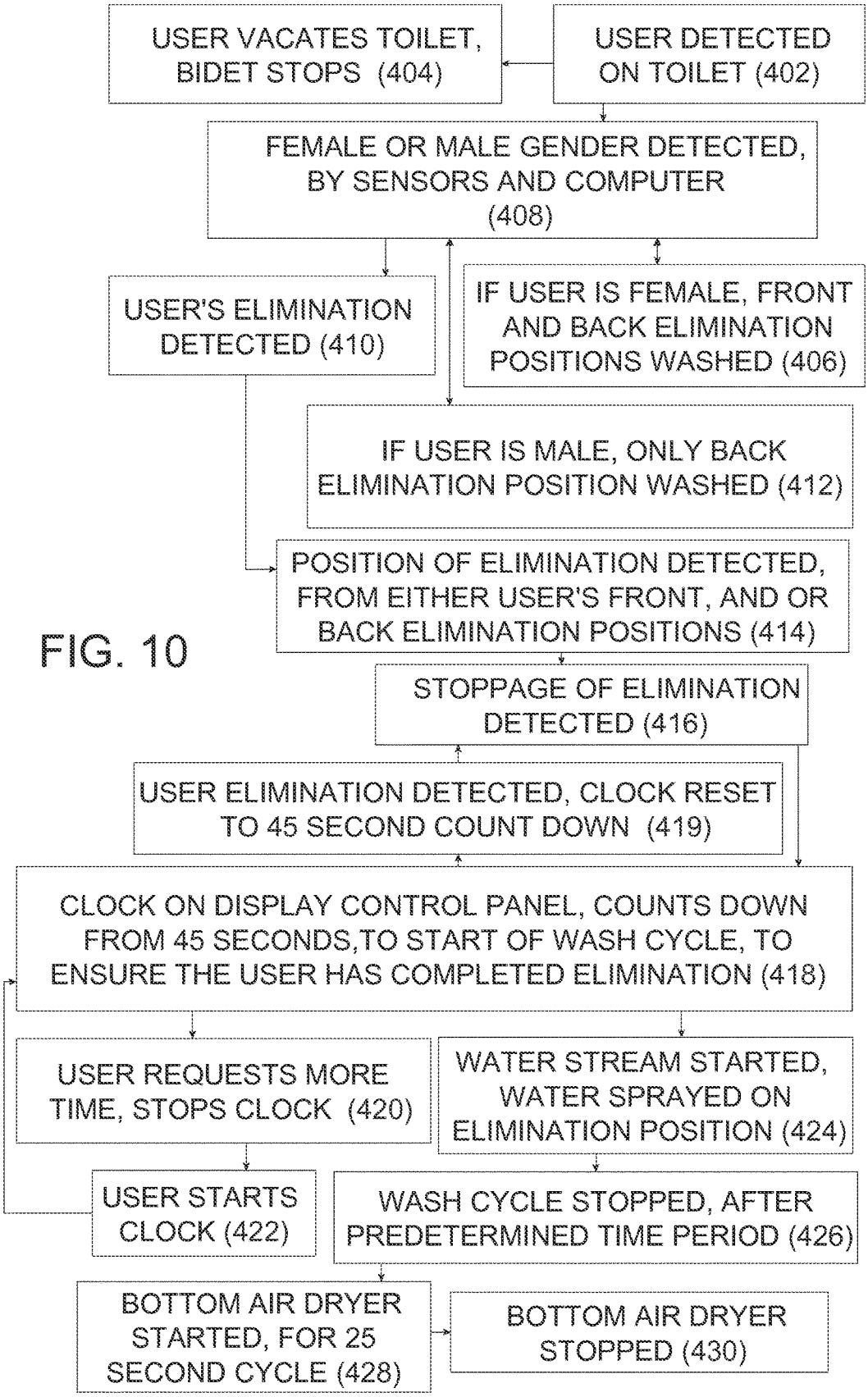
FIG. 10 is a flowchart illustrating a method of operating an automatic bidet.

FIG. 10 is a flowchart illustrating a method of operating an automatic bidet. Software steps of the bidet operation, may include some of the following steps, user detected on toilet 402, user vacates toilet, bidet stops 404, if user is female, front and back elimination positions washed 406, female or male gender detected, by sensors and computer 408, user's elimination detected 410, if user is male, only back elimination position washed 412, position of elimination detected, from either user's front, and or back elimination positions 414, stoppage of elimination detected 416, clock on display control panel, counts down from 45 seconds, to start of wash cycle, to ensure the user has completed elimination 418, user elimination detected, clock reset to 45 second count down 419, user requests more time, stops clock 420, water stream started, water sprayed on elimination position 424, user starts clock 422, wash cycle stopped, after predetermined time period 426, bottom air dryer started, for 25 second cycle 428, and bottom air dryer stopped 430.

Figure 11:
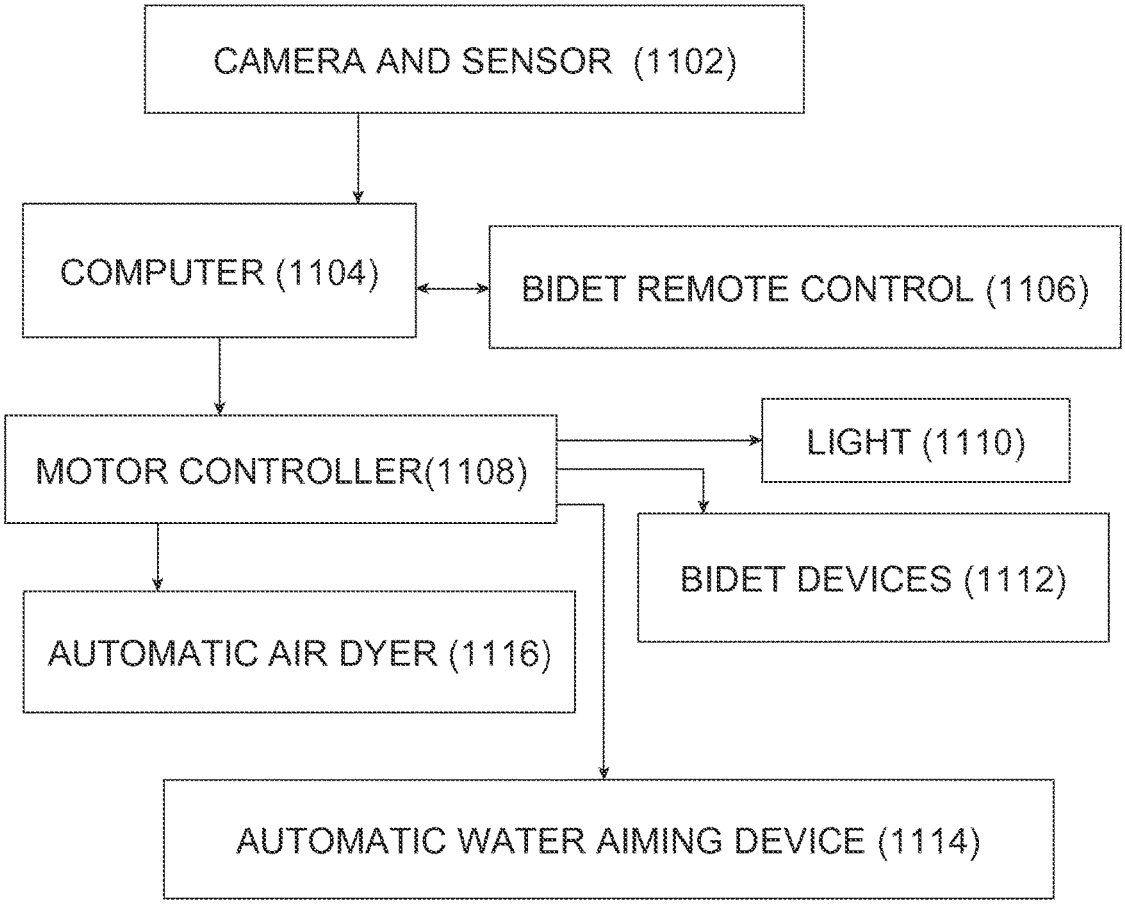
FIG. 11 shows a block diagram of the connected components of an automatic bidet, including an automatic water aiming washing device.

FIG. 11 shows a block diagram of the connected components of a bidet automatic water aiming device. The water aiming device components may include a camera and sensor attached to bidet wands 1102, motor controller 1108, computer 1104, bidet devices 1112, automatic water aiming device 1114, automatic air dyer 1116, light 1110, and bidet remote control 1106.

FIG. 12 is a flowchart illustrating a method of operating an automatic water aiming device. Software steps of the water aiming device, may include some of the following steps, bidet water aiming device computer, receives input, from bidet control panel, or automatic bidet, to wash a user's front or back elimination positions (1202, camera and or sensor identifies, user elimination positions (1204, bidet water stream nozzle is aimed, at user elimination position or positions (1206, water stream is initiated (1208, water stream is monitored, for accurately delivering stream to elimination positions 1210, if stream is off of desired position, stream is moved to desired position (1212, water stream is stopped, and after predetermined time period (1214.

In the detailed description, reference is made to the accompanying figures, which form a part hereof. In the figures, similar symbols typically identify similar components, unless context dictates otherwise. The illustrative embodiments described in the detailed description, figures, and claims are not meant to be limiting. Other embodiments may be utilized, and other changes may be made, without departing from the scope of the subject matter presented herein. It will be readily understood that the aspects of the present disclosure, as generally described herein, and illustrated in the figures, can be arranged, substituted, combined, separated, and designed in a wide variety of different configurations, all of which are explicitly contemplated herein.

When the word connected is used, in the reference to electrical devices, it's implied that the electrical components, are connected by electrical wire and or information conducting, communicating wire. Other components may use other connections, such as, components which are attached by a physical connection, or connected by radio waves, etc.

Safety features include using a ground fault circuit interrupter GFCL. The GFCL is an electrical device that disconnects a circuit whenever it detects, that the electrical current is not balanced between the energised conductor and the return neutral conductor. Such an imbalance may indicate current leakage, through the body of a person, who is grounded and accidentally touching an energised part of the circuit. The GFCL are designed to disconnect quickly enough, to prevent injury caused by such shocks.

The computer means is a processor connected to a storage, for analysing data and storing data. The computer means, is the computer programmed with bidet operating software, genital gender recognition software, elimination detecting, elimination starting and stopping detecting software, and position of elimination detecting software. The sensor means is the sensor and or camera. The bidet means is the bidet. The toilet means is the toilet.

An Automatic Bidet Operation

The user sits on the toilet seat 106, in FIG. 1. The user eliminates, and the bidet washes, directs a fluid, streams water, or delivers water the user's elimination positions.

An example of the female user using the bidet may include, the female user eliminates from both front and back elimination positions. The user watches and waits as the clock counts down from 45 seconds to zero seconds. If the user desires more time, they can reset the timer, by touching, a more time icon, on the display, to count down for another 45 seconds. The user can reset the clock, by touching the, add more time icon button, on the display screen. If the user eliminates while the clock is counting down, the clock will reset to an additional 45 seconds. At zero the user can have both their elimination positions washed simultaneously or consecutively. If the water spray isn't contacting the user's elimination positions, as desired. The user may move their elimination positions, to be more directly in the water spray. The bottom air dryer directs a flow of air at the user's bottom, after the wash has finished. The clock displays a countdown of 25 seconds until, the bottom over dryer finishes. The user vacates the toilet the lid 108 closes automatically. The toilet flushes automatically, after the lid closes.

An example of the male user using the bidet may include, the male user sits on the toilet seat 106, in FIG. 1. The user uses the toilet. The male user eliminates from both front and back elimination positions. The user waits for the wash cycle to start. The user watches a clock, displayed on the remote, count down to the start of the wash cycle. The clocks displays a countdown until the start of the wash cycle, starting at 45 seconds to zero seconds. The user eliminates more elimination, the clock rests to the 45 second count down. At twenty 20 seconds the user resets the clock, by touching, the clock reset button icon, on the touch screen. When the clock displays zero, the wash cycle starts. The user has their back elimination position washed. After the wash has finished the bottom air dryer directs a flow of air at the user's bottom. The clock displays a countdown 25 seconds until the bottom over dryer finishes. At 5 second the user vacates the toilet seat 106 the air dry stops. The lid closes automatically user vacates the toilet. The toilet flushes automatically when the lid closes.

Another example of a female user, using the bidet, include, the user evacuates their bowel and bladder, the cleaning wand 120 washes the bowel opening, with medium wide spray pattern, with a high water pressure setting, and a warm water temperature setting. The bladder opening is washed, after the bowel opening is washed. The bladder opening is washed using the bidet wand 120, with a small width oscillating spray pattern, medium water pressure spray setting, cool water temperature setting, and aerated water setting, etc. When the wash is completed, the bottom air dryer activates with a medium airflow and medium high air temperature setting. After 40 seconds the bottom air dryer turns off. When the dryer turns off, the user vacates the toilet. The lid closes automatically, when the user vacates the toilet seat. The toilet automatically flushes, after the lid closes. The toilet devices automatically power down to sleep mode, after the lid closes. The deactivated devices include, the radio, web page display, seat heater, and bidet, etc.

The user sits on the toilet seat, as shown if FIG. 1. The camera, and sensor's viewing area 104 is inside the toilet bowel. The camera, and sensor view, the user's genital's and bottom, while they occupy the toilet seat. A light in the cleaning wand, illuminates the user's bottom. The camera and 102 sensor, and 102 images the users bottom, posterior. The computer 116 analyses images of the user's posterior, searching for male genitalia. If male genital is detected, the washing of the urinary eliminatory opening is prohibited.

The camera 102, sensor, and computer 116 analyse images of the user's posterior, searching for female genitalia. If female genitalia is detected, the washing of the female urine elimination opening is allowed. The computer also searches for female genitalia, and if no female genitalia is found, then it's assumed the user is male. The computer also searches for male genitalia, and of no male genitalia is found, then it's assumed the user is female.

The camera waits for the stopping of elimination. If the camera detects elimination from the male's front. The computer doesn't start, the directing of water, on the back elimination position, until the front elimination position has finished eliminating.

When the stopping of back elimination and front elimination is detected, the bidets waits for 45 seconds before washing the back position. The waiting wash time, is used to be sure the user, has finished eliminating before washing. When female front stoppage of elimination, is detected, the bidets waits for 30 seconds before cleaning, directing water at the front position.

The bidet cleans the user's front and back position, using a stream of pressurized water sprayed, from nozzle water openings 122, 134 in the cleaning wands 120, 132. One cleaning wand 132 cleans the users back position, and the other wand 120 cleans the user's front position. In alternate bidets embodiments, one wand is used to clean both, the front position and back position. The computer moves the water stream nozzle, to the front and or back elimination positions.

If both elimination positions are used for elimination, the bidet waits for the eliminatory positions to stop eliminating from both positions, before cleaning. The bidet can also be programmed to clean the position, which was the first position to stop eliminating, and then clean the last position to stop eliminating. If elimination starts again, after the cleaning process has completed, then the cleaning cycle will start again.

The bidet can be set to automatically wash, a female's front and back elimination positions, even if only one elimination position is used for elimination.

After the bidet stops washing the bottom, dry air is blown on the user's bottom. The air dryer inside the toilet bowel, directs air to the users bottom for 25 seconds. The pre-set drying time can be increased or decreased by the user.

If elimination is detected while the elimination positions are being washed or dried the, wash or drying is stopped. The bidet resets, to the waiting for elimination to stop, part of the cycle. The bidet starts the wash 45 seconds after the elimination has stopped.

The remote can be used to manually activate the bidets devices, by touching the control icons associated, with different functions of the bidet. The remote can control the start and stop of the front bidet wash, the backwash, and the turning on and off of the bottom air drier, the water temperature, the water pressure, a toilet seat heater, changing the water spay pattern, radio, and internet connection, for surfing the web, etc. The remote can be used to pre-set, air blower drying times, and the activation the wash cycle after elimination times, etc.

The user can stop and restart the bidet, by pressing a stop and restart icon on the display, the system can be reset by touch activating the reset icon. The user can override the automatic wash process and operate the bidet manually, by using the bidet control panel 142. The bidet settings, can be set to pre-set default settings, by touch activating the default icon.

The automatic hygienic, sanitary bidet decreases transference of bacteria to the users hand, by the limiting the user's hand contact with a possible bacteria on a bidet control panel. The automatic bidet decreases mental effort, needed to operate the bidet. Limiting the user's contact with a bidet remote control panel, may limit the transmission of bacteria from the remote control the user's hands. The bidet removes a higher percentage of bacteria from the user's bottom, then using toilet paper to clean with. Limiting the uses of toilet paper, reduces the transference of bacteria to the users hand while cleaning. Limiting elimination position contact, with toilet paper, may reduce irritation of the eliminatory positions, caused by contact with the toilet paper. Limiting toilet paper use, by using the bidet, conserves toilet paper

Alternate Embodiments

Figure 13:
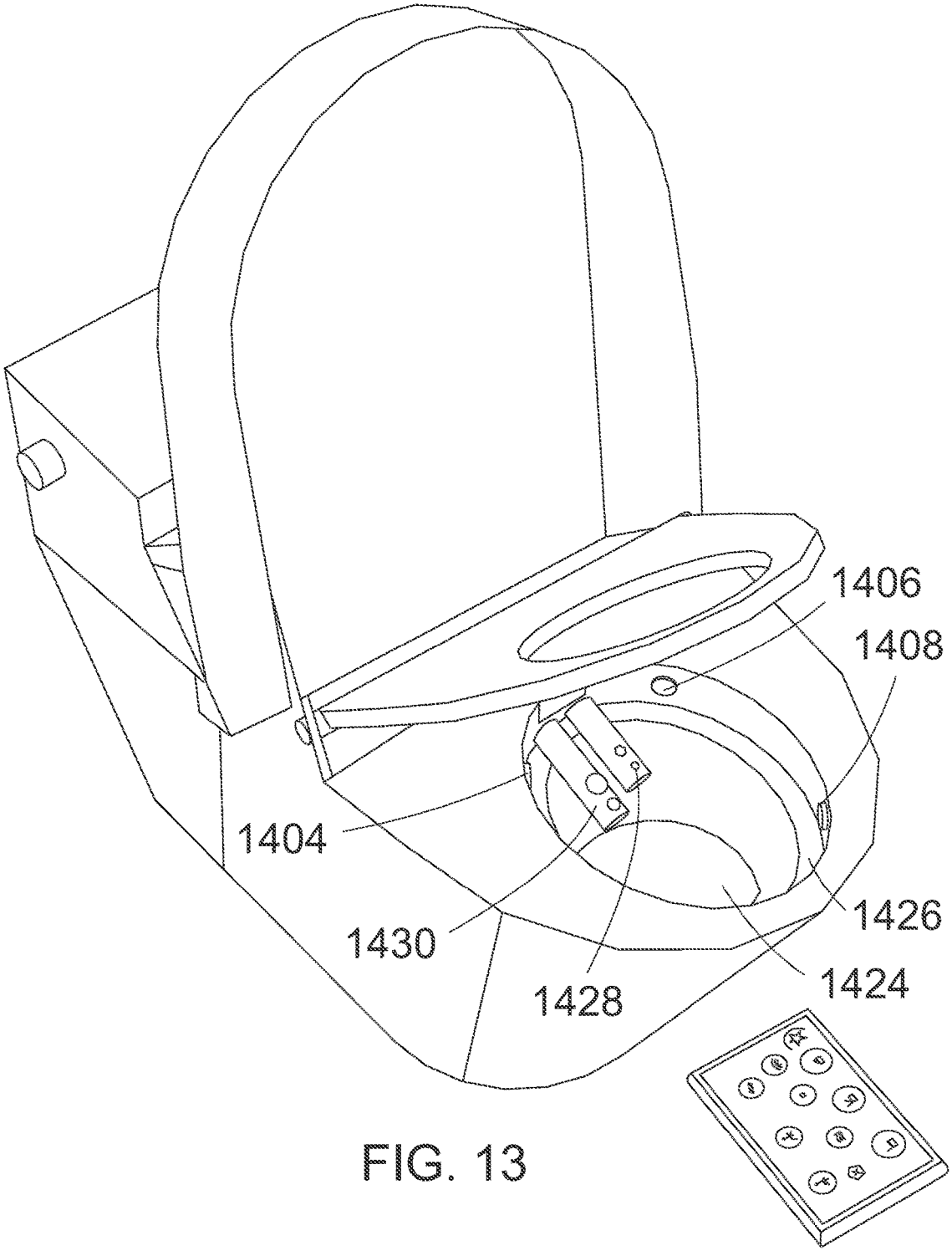
FIG. 13 shows a perspective view of an automatic bidet with microphones inside a toilet bowel.
Figure 14:
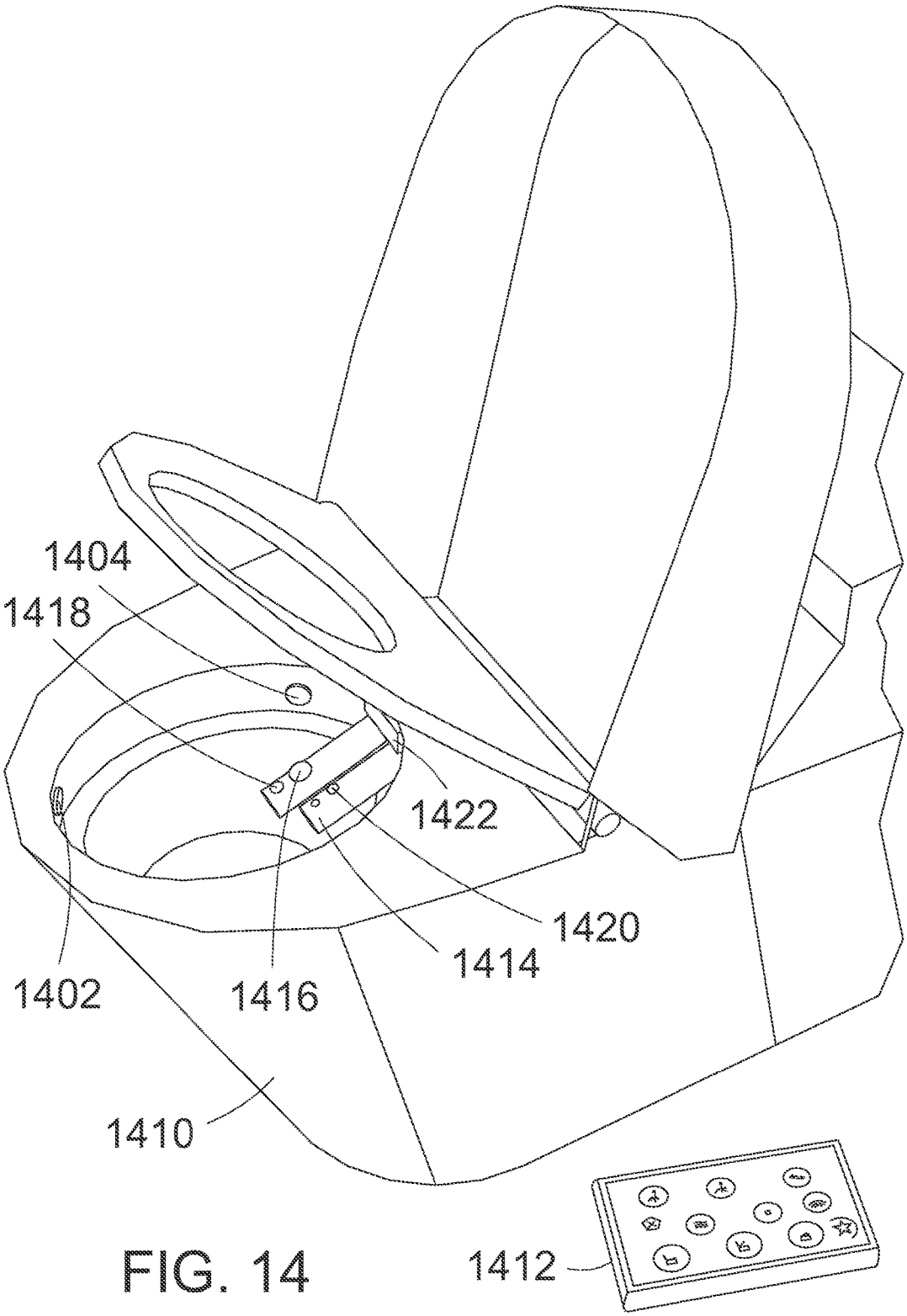
FIG. 14 shows a perspective view of an automatic bidet with microphones inside a toilet bowel.

Microphones Used in the Sensing of a User in the Operation of an Automatic Bidet Description and Operation An automatic bidet is connected to 4 micro inside a toilet bowel, as illustrated in FIGS. 13 and 14. The microphones 1402, 1404, 1406, and 1408 are connected to a computer. The computer is located inside the toilet housing. A remote control 1412 communicates with the computer wirelessly. The microphones are above the level of resting water 1424 in the bowel 1410. The microphones are water proofed Four microphones are attached inside the top of toilet bowel. The microphones are arranged symmetrically, with one micro in each quarter of the toilet bowel. One microphone is attached to the front right side of the toilet bowel. One microphone is attached to the front left side of the toilet bowel. One microphone is attached to the back left side of the toilet bowel. One microphone is attached to the back right side of the toilet bowel.

Sound elimination detected in the front of the toilet bowel is deduced to be front elimination, the elimination of urine by the user. Sound elimination detected in the back of the toilet bowel is deduced to be back elimination, the elimination of fecal matter by the user.

The sound produce by front elimination, and the sound produce by back elimination, can be used to discern the start, of front, and back elimination. The continuation of the elimination sound, signals ongoing elimination. The stopping of the elimination sound is associated with the stopping of elimination. The microphones are used as audio stopping of elimination, detecting devices.

A gender genital imaging recognition camera 1416 is attached to the bidet wand 1430. Using genital recognition software and images of the user's genitals, from the bidet camera, the computer is able to determine the user's male or female gender.

The computer uses the microphones 1402,1404,1406, 1408 and camera 1416 data gather about the user to automatically wash the user after they have eliminated while sitting on the toilet. The computer which is connected to bidet, and using the data gather about the user by the microphones and camera, is able to instruct the bidet to automatically stream water from the bidet wands 1414, 1430 water nozzles 1418, 1428, to a females front and or back position of elimination, or stream water from the nozzles 1428, 1418 to a male user's back elimination position, after elimination has taken place.

The computer 1410 can also use audio elimination detection, urine elimination sound recognition software and fecal elimination sound recognition software, to discern weather feces or urine is being eliminated, as illustrated in FIGS. 13 and 14. The computer analysis's the sound of elimination in the toilet bowel 14, detected by the microphones. The computer compares the sound of elimination, inside the toilet bowel, to stored profiles of urination sound and the expelling of fecal matter, inside the toilet bowel. The urination sounds are the sound of expelled urine contacting the resting toilet bowel water 1424 and or urine contacting the toilet bowel 1426. The expelling of fecal matter sound is the sound of expelled fecal matter contacting the resting toilet bowel water 1424. The if both front and back elimination is taking place at the same time, the computer can determine, by analysing the sounds, that both front and back positions have eliminated.

By detecting and identifying the feces and or urine sound, the computer can determine whether front and or back elimination is taking place.

The by analysing the sounds computer can detect the user's front and or back position of elimination, the starting of elimination, the stopping of elimination.

A gender genital imaging camera is attached to one of the bidet wands. Using genital recognition software and images of the user's genitals, from the bidet camera, the computer is able to determine the user's male or female gender.

The computer 1410 which is connected to bidet 1422 is able to automatically wash, stream water from the nozzles 1418, 1428, to a females front and or back position of emanation, or stream water from the bidet wands to a male user's back position of elimination, after elimination has taken place.

The bidet 1422 can be set by the user using the remote 1412 to also stream water from the nozzles 1418, 1428, to the male user's front elimination position, the user's penis. The streaming of water, from the bidet nozzles 1418, 1428 to the male elimination position, can be set for after the user' eliminates from the front position. The streaming of water to the male elimination position, can also be set for after the user' eliminates from the back position, even if the user hasn't eliminated from the front position. The male's front position can be washed whether the front position is eliminated from or not eliminated from. The males front elimination position can be dried using an automatic elimination position drying device. The drying device uses an air flow flowing from a nozzle 1420 in the wand 1414, to dry water on the user.

Figure 2:
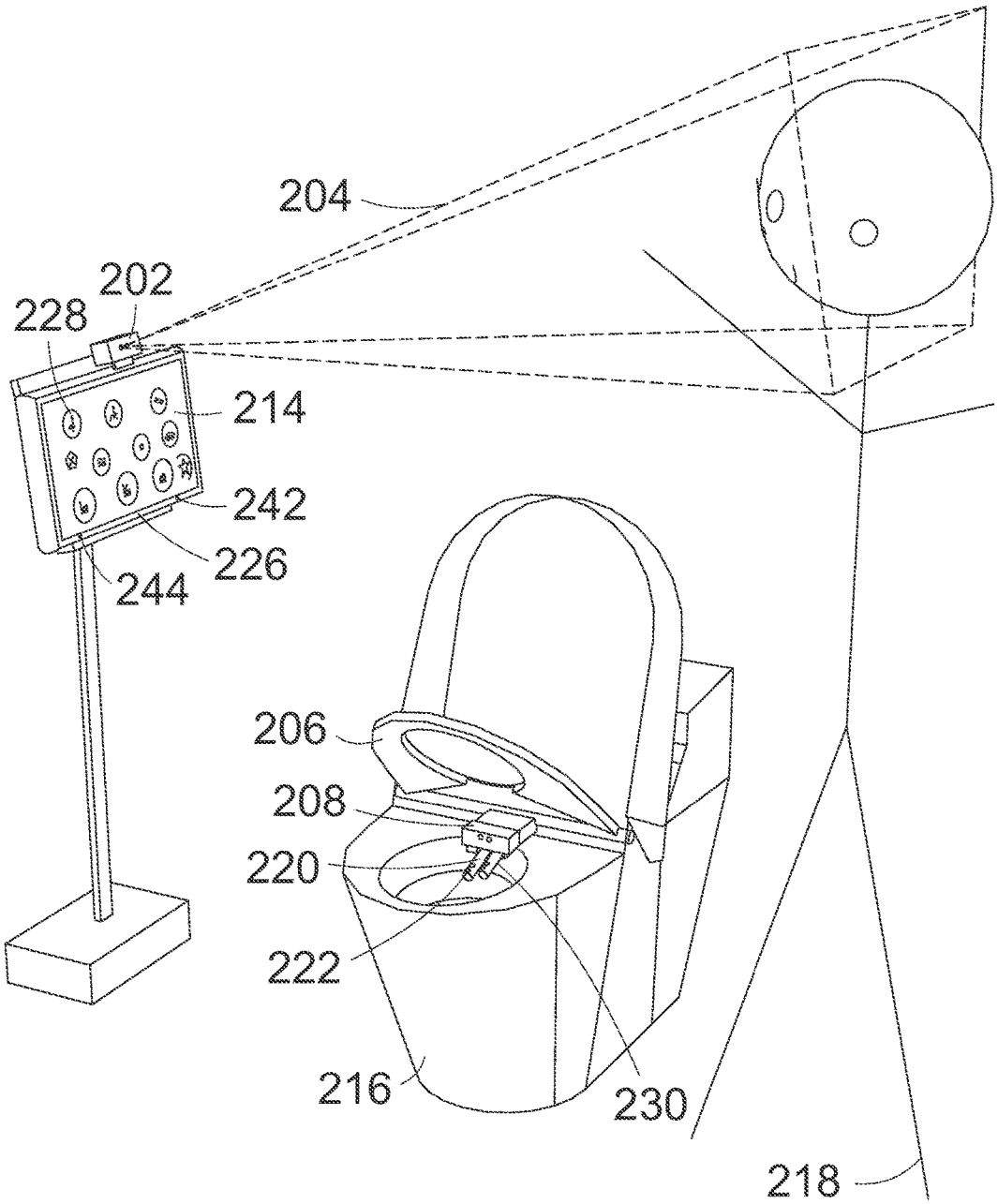
FIG. 2 shows a perspective view of a toilet having an automatic bidet, with a facial recognition camera, and a bidet remote control.

Facial Recognition Used for Gender Recognition for an Automatic Bidet Description Facial gender recognition is used for gender detection for an automatic bidet 208, is illustrated in FIG. 2. A facial gender recognition camera 202 is attached to a bidet remote control 226, and is used to detect a user's 218 gender.

The bidet remote camera 202 connects to a computer (not shown) which uses Intel facial gender recognition software made by the Intel Company, of California. The facial gender recognition software uses facial images of the user to detect the user's gender. The camera 202 is positioned to have, a perpendicular view 104 of the users face, while they are sitting on the toilet. The user turns their face to the camera when they sit on the toilet 216.

The computer in the remote connects wirelessly to the computer in the toilet 226, which is connected to the bidet. The wireless remote control has a touch screen display 214 to input commands to the bidet. The user can input commands by touching displayed icons 228. The icons are associated with activating differing bidet devices and bidet device's settings. The remote connects wirelessly, to the bidet. The remote has a speaker 244 and a microphone 242.

The remote 226 can connect to the internet, and display web pages on its display 214. The user can surf the internet using the remoter touch screen display 214. The remote can attach to a wall surface, and also detach from a stationary position, and be portable.

A camera detached for the remote (not shown), can also be used to gather facial recognition information of the user. The detached camera could be an Intel camera. The detached camera, can be placed facing the user, with the user facing the camera, to observe the user's face, while they are sitting on the toilet. The detached camera can connect to the remote wirelessly or computer. The camera can also be an infrared camera. The detached camera can connect to the bidet computer, by a wireless connection.

The detached camera, the user interaction zone extends from around 10 centimeters to about 2 meter, from the front of the camera 626. The remote camera's 202 user an interaction zone 204, extends from around 10 centimeters to about 2 meter. The remote 202 camera, uses Intel facial recognition software, to detect the user's gender. The remote views the users face, to detect the users gender. The detected gender, is used to influence the positioning of the bidet water stream. The computer is incorporated in the remote 226. The remote is a touch screen display 214.

The bidet 208 can also use a genital recognition camera 222, device, with the facial recognition camera to detect the user's female or male gender. The genital recognition camera 222 is used, as a second gender detecting source. The genital detecting camera is attached to a bidet cleaning wand 220. The bidet has a second wand 230. The bidet also uses an automatic water stream aiming device, to direct water to the user's elimination positions.

Visual elimination recognition software can be used to detect the back elimination positions of a female and male user. The computer can use urine and fecal visual recognition software, to analyse the image data of a user's elimination. The software is used to detect whether elimination is urine or fecal matter, and to determine the back elimination position of a female and male user. Knowing the composition of elimination, allows for the bidet to deduce the elimination position of the elimination. If urine is detected then elimination would be from the front position, if fecal matter is detected elimination would be from the back position. The water stream can then be directed to the front and or back positions, when elimination is finished.

Facial Recognition Used for Gender Recognition for an Automatic Bidet Operation

The user sits on the toilet seat 206. The user faces the camera 202 in the remote 226. The user's gender is determined using facial recognition. The user is automatically washed after elimination, by the automatic bidet 208. The automatic bidet 208, uses facial gender recognition, the automatic water stream aiming device 230, and the remote control 226.

A Detachable Toilet Seat Assembly Connected to an Automatic Bidet Description

Figure 3:
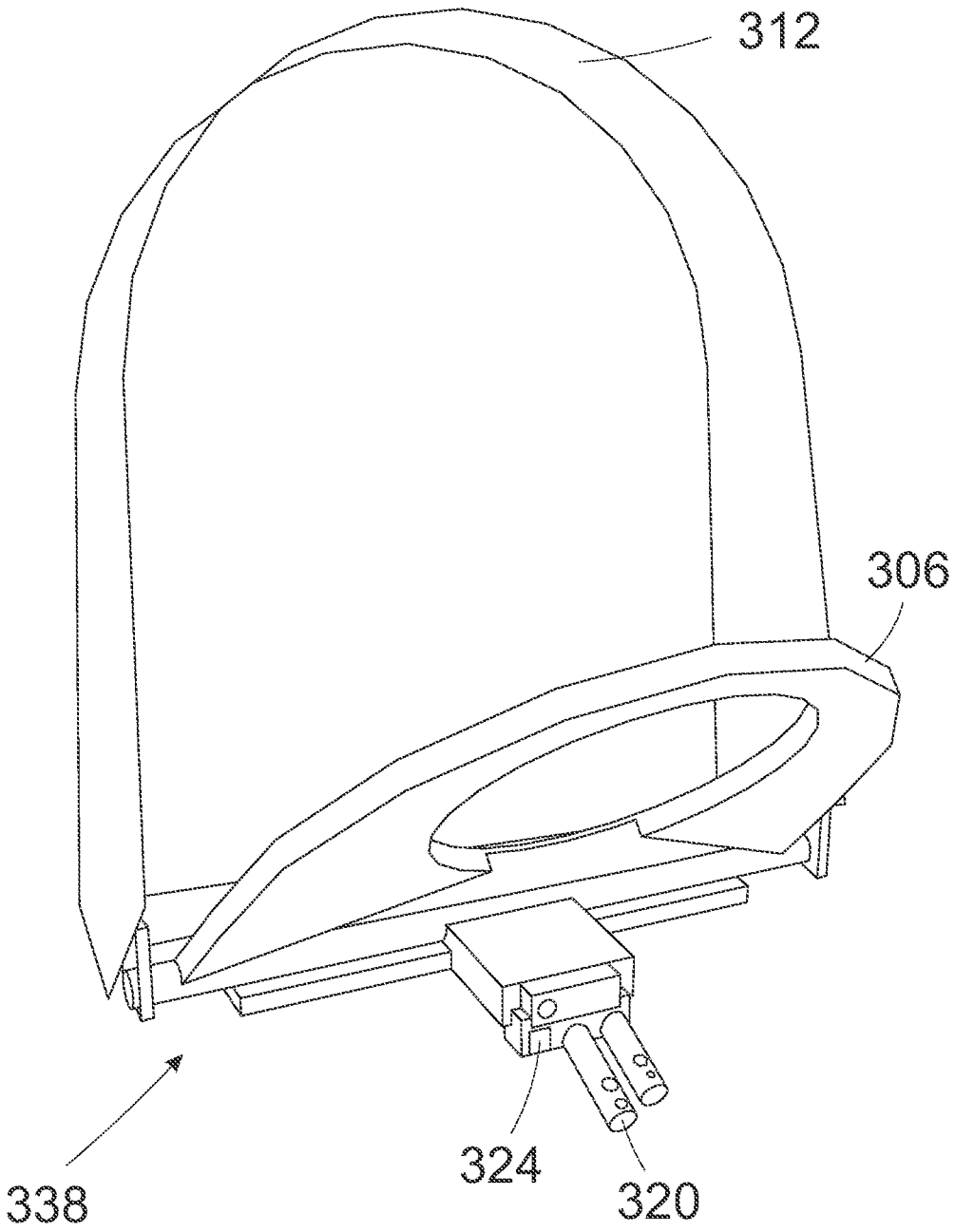
FIG. 3 shows a perspective view of a detachable automatic bidet.
Figure 4:
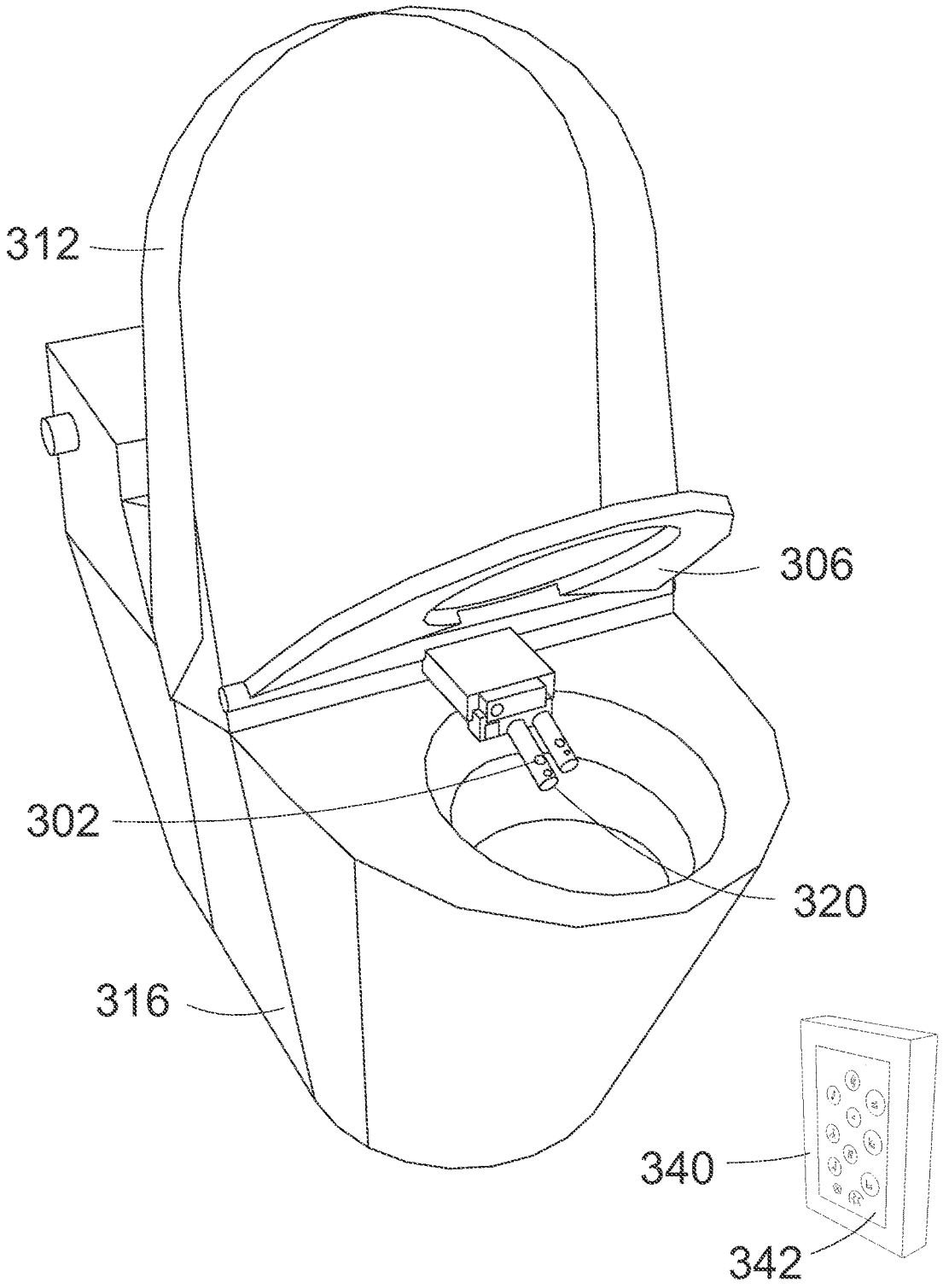
FIG. 4 shows a perspective view of a detachable automatic bidet, incorporated into a toilet.

The detachable automatic bidet assembly 338 is temporarily removable and attachable, to a toilet 316, as illustrated in FIG. 3. A detachable bidet assembly 338, comprises, a bidet, connected to a toilet seat 306, the seat is connected to a toilet seat lid 312, and is connected wirelessly to a remote control 340. The bidet assembly is detachably connected to a toilet, as illustrated in FIGS. 3 and 4. The bidet uses a temporary attachment and detachment device, to connect to the toilet.

A bidet remote control 340 having an input display 342, connects wirelessly to the bidet. The bidet has a bottom air drier 324, located near a cleaning wand 320. The cleaning wand having a genital recognition camera 302. The automatic bidet uses a detachable bidet assembly, with an automatic water stream aiming device, and remote control with facial recognition.

A Detachable Toilet Seat Assembly Connected to an Automatic Bidet Operation

The automatic bidet is connected to the toilet seat 306, and toilet seat lid 312, is attached and detached from the toilet, by releasing the quick release connectors (not shown), which attach the assembly to the toilet, as illustrated in FIGS. 3 and 4. The assembly 338 can be reattached, by sliding the assembly connectors on to the toilet connectors, and locking the connectors.

User Profile Recognition Used with an Automatic Bidet Description

Recognition, by the automatic bidet, of a user can be used to activate, a user's pre-set automatic bidet settings. The setting are used with the operation of the bidet. The identified user may have their pre-set, preprogrammed, bidet preference settings, and cycles activated.

Figure 5:
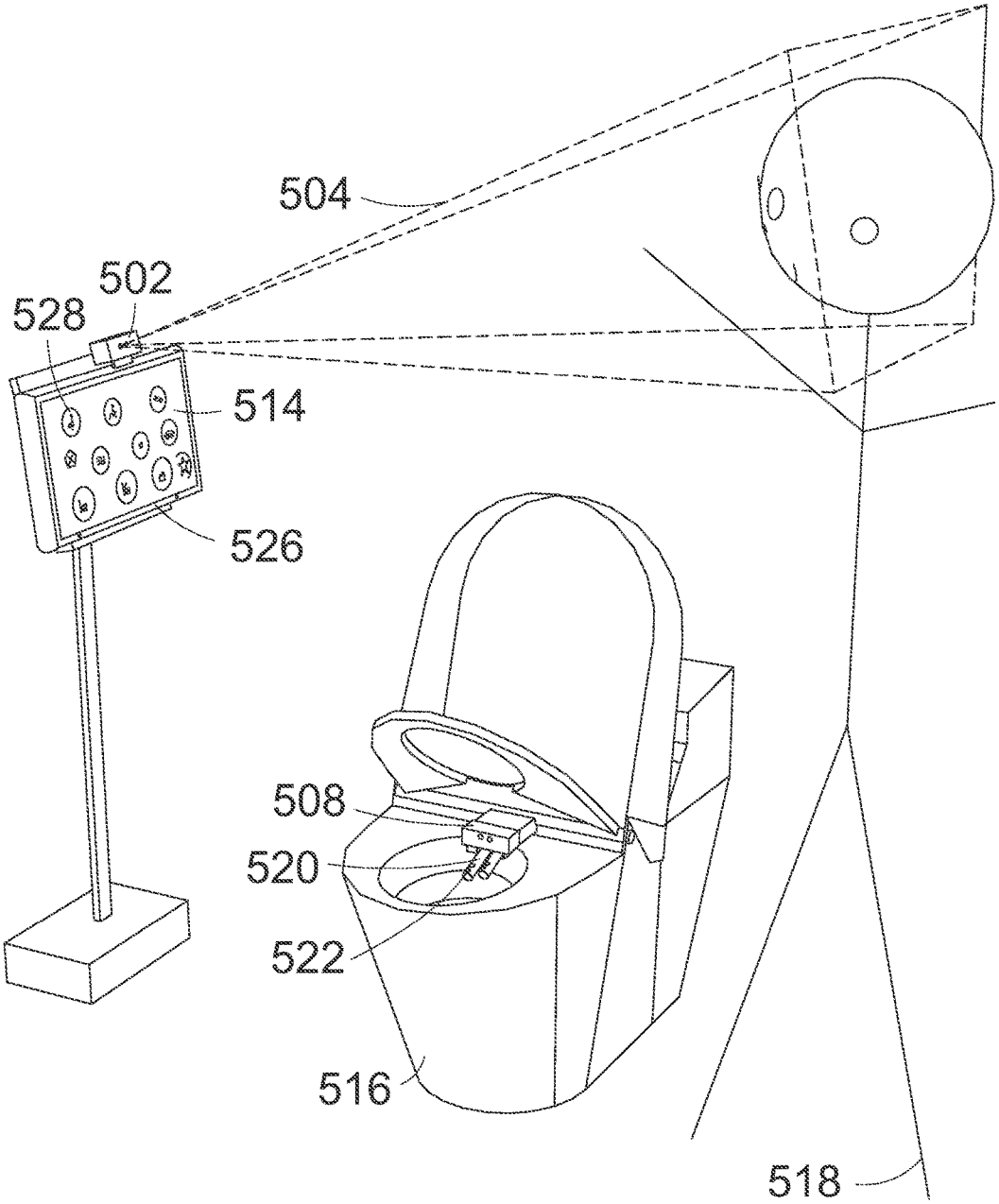
FIG. 5 shows a perspective view of a facial identifying device, an automatic bidet with user profile bidet settings programmed into the bidet.

Illustrated in FIG. 5, is the use of facial recognition and genital recognition for the activation, of pre-set bidet functions, associated to a recognized user's face and genitals. Pre-set bidet functions, may include, water temp, water spay pattern water spray pressure strength, bottom blow drier temperature, blow drier air speed, etc. The user identity devices may use facial recognition, and or genital recognition to identify the user.

A user's face 518 is associated with a stored user profile. The user profile contains pre-set bidet seating. The user profile is activated when the user is recognized by the camera 502 when the user is in the vicinity of the bidet 508. The activated bidet setting, set the bidet devices. The profile is stored in a computer 526. The computer is part of the input display panel 526. The camera views the users face, the user's face is within a camera facial viewing zone 504. The camera which is connected to the computer, sends the images of the users face to the computer. The images are analysed by the computer and computer software. A genital camera 522 is incorporated into a cleaning wand 520.

The user can use the remote to pre-set devices settings, such as, increasing water temperature, decreasing the water pressure spray, changing the water streaming time period, changing the amount of time until the wash cycle activates, etc. Pre-set bidet functions, may include, water spay pattern, bottom blow drier temperature, blow drier air speed, etc.

The computer 526 searches its data base for a match with the sitting user, and stored elimination positions, and user elimination position information. If the match is found, the user is identified, and the associated identified user pre-set bidet functions, are activated.

User genital recognition is also used to activate pre-set bidet settings. User genital recognition can be associated with the user's profile. The computer can recognize the user by their genitals. The recognized user's associated bidet profile, of pre-set bidet setting, can be activated.

The camera 522 views the user's genitals. The camera connected to the computer send the images of the users genitals to the computer. The images are analysed by the computer and computer software.

Genital recognition is also used for the activation of pre-set bidet functions associated to a recognized user's genitals. The profile may contain bidet setting, such as, water temp, water spay pattern water spray pressure strength, bottom blow drier temperature, blow drier air speed, etc. The computer 526 searches its data base for a match with the sitting user and stored genital images and user elimination position information. If a match is found, the user is identified, and the associated user pre-set bidet functions are activated.

The computer can create a user's profile without the user's input. The computer remembers the user's bidet input and creates a profile with the remembered setting which is associated with the user. For example, on initial use, the computer checks the user's image 1104, with stored user images, if the computer 526 doesn't find a match with the new user's identity and stored identities, the computer classifies the user, as a new user. The computer creates a new user profile, for the new user. The user's 518 image is saved, and the saved image is associated, with the image in the new profile, and the user's toilet device operation sequence and toilet device setting are saved. The computer remembers the user's chosen, preferred toilet device settings, if the user activates the devices manually, or by using the interactive display, to activate or deactivate the toilet device.

For example, if on initial use the computer discerns, that the user is a new user, the computer saves their image in a new user profile. If the user moves the seat, to the down position and lid to the up position manually, using their hand, the computer saves the seat setting sequence, to the new user profile, the user uses the three dimensional display to operate the bidet back wash, with a warm water setting, the user to manually end the bidet wash cycle, by activating the spot icon button on the display.

The computer will remember these user's device preferences and setting and use this profile, to activate these devices, the next time the user's image is recognised, and is matched to their stored image. The user can create their user profile by touch inputting data into the profile using the input panel display screen 514. The display offers the user a menu of bidet settings, which the user can choose to input, into their profile. The pre-set bidet settings can be input, by inputting the bidet settings into their stored computer profile.

There are many alternate ways to touch freely activate the user profile, for example using, a smart phone wirelessly inputting the user identification, Direct Wi-Fi recognition, a user eye recognition device, a wireless proximity card user identification, near frequency communication with a user's cell phone, or a combination of the different user identifying devices can be used.

A user's preprogrammed profile when activated, can affect the setting and operation of toilet devices, such as, a lid positioning motor, a seat positioning motor, a heated seat, a bottom air dryer blower, a bidet front wash, a bidet back wash, a toilet flush device, a bidet wand forward and backward mover, a seat massager, an air purifier, a stop button, an internet connection, a music player, etc.

The user profile of bidet pre-set setting, can be stored on the internet and accessed on the cloud, or on the bidet remote. The setting are stored on a server, having a website, used for storing settings. The bidet computer has a connection to the internet. The bidet computer connects to the internet. The computer accesses and downloads the settings, from the web site. The settings are used in the automatic operation of the bidet.

The remote 526 can be used to manually create the profile of the device setting. By touching a displayed menu 514, of differing bidet device icons 528, which are associated with different functions of the bidet 508. The touching of the bidet device fiction icons with a user's fingers, can change the devices settings. The changes made to the devices settings can be saved in the profile. Eye tracking input, and voice recognition could also be used to input device setting into the computer 526.

Other user recognition devices, identifying advices, may be used, such as, eye recognizing devices, the user's cell phone transmitting the user's identity to the bidet using blue tooth radio, Radio Frequency Identification cards, etc.

The automatic bidet includes, facial recognition and genital recognition to activate the user's profile of pre-set bidet settings, an automatic water stream aiming device, a detachable bidet assembly and a remote control 526, the assemblage is illustrated in FIG. 5.

The user profile of bidet device settings, used together with the automatic bidet 508, may automatically wash a user. The automatic bidet and activation of the user profile allows the user to complete a bidet wash cycle, without having to add further input.

User Profile Recognition Used with an Automatic Bidet Operation

Illustrated in FIG. 5, the user 518 sits on the toilet seat 506. The user sits on the toilet 516 and their face and genitals are imaged. The user is recognized by their face and genitals. The users profile is activated, and their pre-set automatic bidet settings 526 are activated. The activated setting are used in the operation of the automatic bidet devices 508. The users pre-set bidet settings, for example, may include, a warm spray water temperature, a pulsating water spray, a 35 second cleaning cycle, a heated toilet seat, etc.

Figure 6:
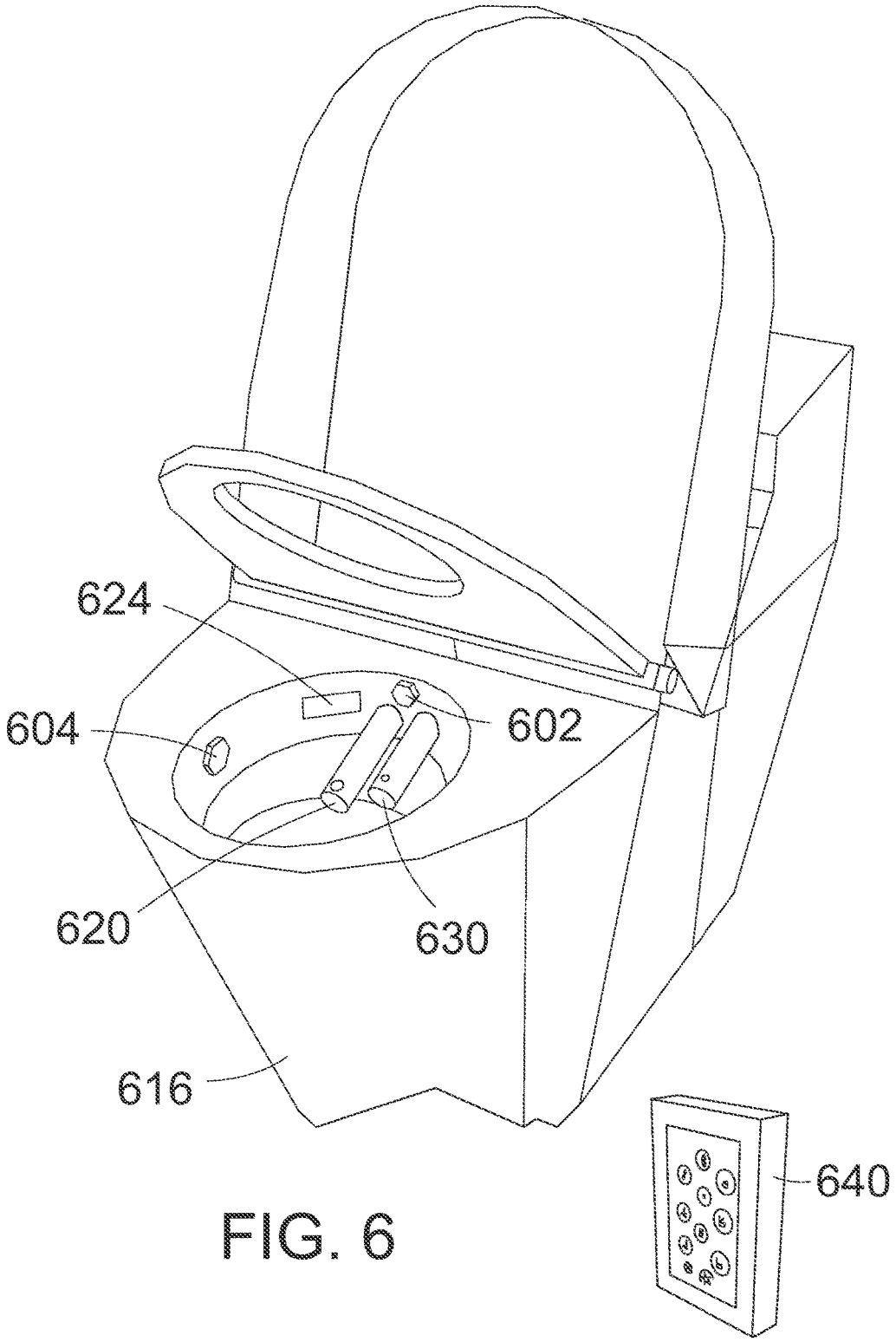
FIG. 6 shows a perspective view of an automatic bidet with sensors inside a toilet bowel.

Cameras and Sensors Positioned at Differing Locations in the Toilet Bowel Used with an Automatic Bidet Description Sensors and cameras are arranged around a toilet bowel, are used to collect information about a user's as their sitting on the toilet, as shown in FIG. 6. The information is used to automatically wash the user's elimination positions. The sensors and camera are connected to a computer in an automatic bidet.

The computer uses the data collected about the user sitting on the toilet, to wash the user's elimination position. The sensors and camera information is used to determine the user's gender, the starting of the user's elimination, the stopping of the user's elimination, the front or back position of elimination. From the collected user information, the bidet is able to automatically determine which elimination position or positions to wash. The bidet moves water spraying cleaning wands 620, 630 to the user's positions of elimination. The cleaning wands directs cleaning water on the user's elimination positions.

More than 4 sensors and camera can be used to gather information about the user, such as, 5 to 6 cameras and sensor. One camera 602 is attached to the back of the toilet, one camera is attached to the left side of the toilet. One sensor 604 is attached to the left side of the toilet 616, one sensor is attached to the front of the toilet (not shown). The sensors and camera are connected to a computer in the toilet housing.

A light 624 is used to illuminate the user's elimination positions. Four additional lights (not shown) are arranged around the toilet bowel area, they are used to further illuminate the user's elimination positions.

A touch screen display panel bidet remote control 640 is used to change the bidet device setting and can be used to manually operate the bidet. The remote can give the user feedback, about the operation of the bidet. Displayed feedback on the remote display, may include the time left in a bidet wash cycle, the temperature of the bidet water, etc.

The camera is cleaned after each use by, a camera water cleaner (not shown), using pressurized water flowing over the camera. A light illuminates the inside of the toilet bowel, to aid the camera in viewing, the user's elimination positions.

A water motion sensor to detect elimination, such as, a sonar or laser water motion detector, is used to detect the start of user elimination and the stopping of elimination. The sensor is under the toilet bowel water, contacting the water. The sensor detects motion in the water. The detection of movement signals the start of elimination, and the stopping of water motion signals the stopping of elimination.

Cameras and Sensors Positioned at Differing Locations in the Toilet Bowel Used with an Automatic Bidet Operation The user uses the toilet. The user's elimination positions are automatically washed by the bidet. Air blowing nozzles (not shown) near the cameras and sensor, blow off any water or fecal matter that may obstruct their view, while the bidet is streaming water. If more cleaning of the cameras and sensor is need the wands are cleaned with water. After cleaning the wands will, proceed with washing the user's elimination positions. The air drier nozzle dries the cameras and sensor after they have been washed.

Figure 7:
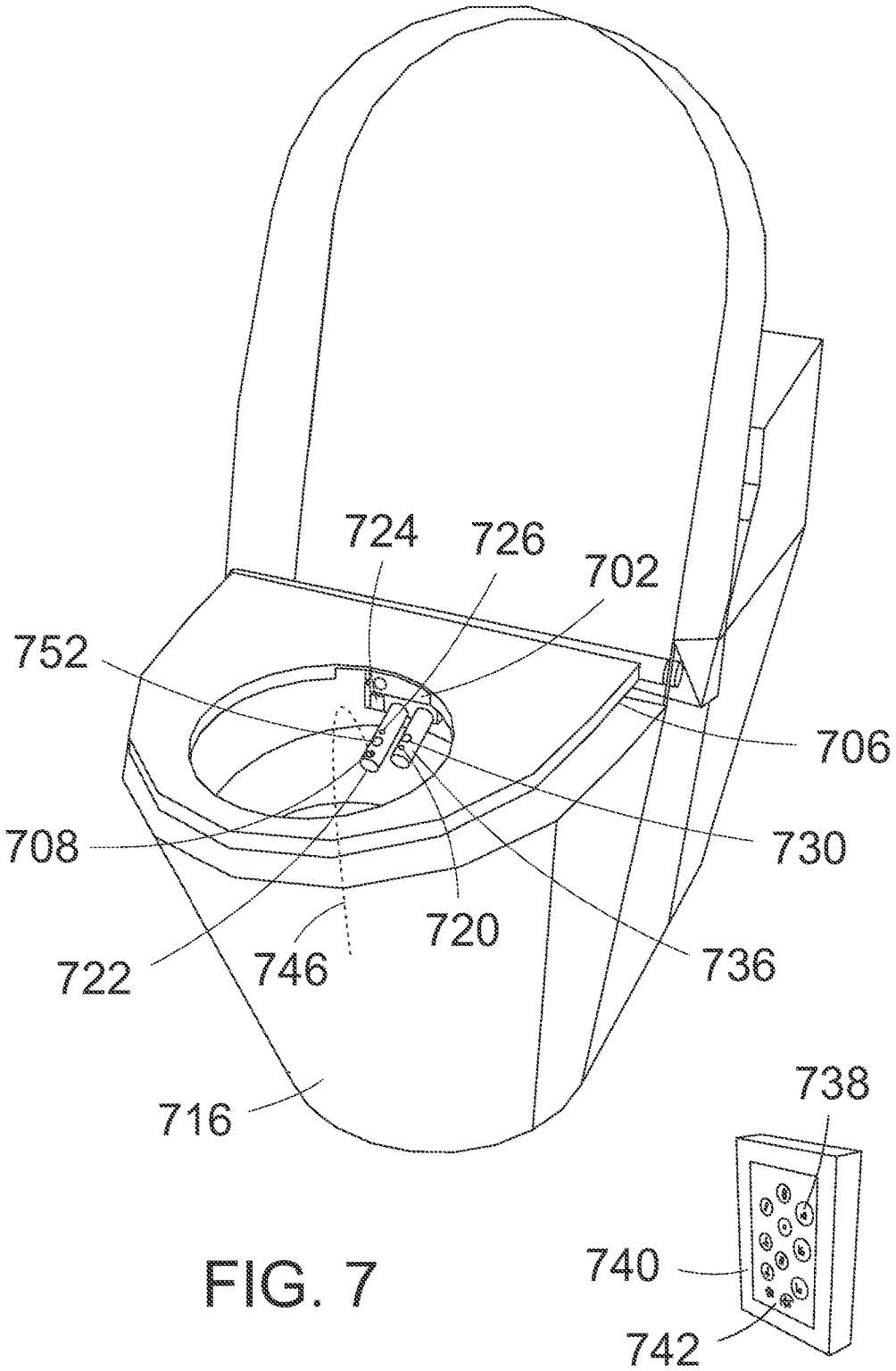
FIG. 7 shows a perspective view of an automatic water aiming device incorporated into an automatic bidet

An Automatic Water Stream Aiming Device, with an Automatic Bidet Using Description The automatic aiming device receives instructions to wash the female users front or back elimination position, or males back elimination position, as shown if FIG. 7. The instruction to wash the user, can be from an automatic bidet 702, or a manual instruction from a bidet remote control 740.

The user's elimination position and gender are determined. After elimination, while the user is sitting on a toilet seat 706. The computer move the cleaning wand or wands to the user's front or back elimination position.

When the wands 722, 736 reach the elimination position, the computer moves the wand and or wands water stream so that to the users water streams directed at the elimination position.

Elimination following software to keeps the water stream on the elimination position. If the user moves while water is being streamed on the elimination position. The computer uses a database, of various female and male front and back elimination sites, to aid in identifying the user's elimination sites. The assembly uses a variety of ways, to identify the user's elimination positions.

The bidet uses the automatic water stream aiming device, to direct and target, the stream of water to the users, elimination positions. The bidet's water stream moves to the user's bottom cleaning positions (not shown), instead of the user having to move the bidet water stream. If the user is sitting off center on the toilet seat, the wand will move the water stream, to the users off center elimination positions. The water stream will adjust its position, to target elimination positions, such as, people having different shapes and sizes.

The bidet 702 can be operated manually, in FIG. 7, with the user inputting the bidet's operating settings, by touching activating, with their finger, displayed bidet operating function icons 738, on the display 742. The bidet can be operated automatically, using the automatic bidet.

The computer is connected to a camera 752 and sensor 730. The computer is located in the bidet housing 702, and communicates with the remote 740 wirelessly. The computer keeps the elimination position in view, and moves the water stream closer to the elimination position, and follow the elimination position. The camera and sensor visually views the stream, and elimination position, until the stream reaches either the front or back elimination position. The water stream contacts the elimination positions, for a predetermined time period, such as, water sprays on the back position for 40 seconds, and the front position, receives the water stream for 25 seconds. The user's posterior is dried by a posterior air drier 724. A light 726 is used to illuminate the user's elimination positions, which is attached to the cleaning wand 722. The illumination of the eliminations positions improves the camera's imaging of the elimination positions.

If the automatic water position aiming device, is unable to target the user's elimination positions, the water stream will move to the default front and back positions, and the user can move their body positions to the default water stream. The bidet's water stream can also be set, to a default front and back positions in the toilet, without activating the automatic bidet water aiming device. In the default position, the user can, may have to move their positions, to the streaming water, while on the toilet 716.

The bidet wands 722, 736, are attached to motors or linear actuators (not shown) that can move from right to left, and up and down, in relationship to the bidet. The wands can extend and retract, into the bidet 702. Each wand had a water nozzle 708, 720, from which water is streamed. The water stream pressure can be increased, or decreased to change the direction of the water stream 746. The wands can pivot left or right, the wand water nozzle attached to the wand can rotate, clockwise or counter clockwise. The wands can move, to direct a water stream to the user's front and back elimination positions. The wands movements are directed by the computer. The wands can move simultaneously, or individually, depending on the elimination position or positions to the cleaned.

The computer use's front and back female elimination position recognition, to recognize the female user's front and back female elimination position elimination positions. The computer use's front and back male elimination position recognition, to recognize the male user's front and back female elimination position elimination positions. The female user's front and back female elimination position elimination positions may have water streamed on them. Only the males back elimination position has water streamed on it.

With elimination positions recognized, the computer can target the position, and aim the water stream at the center of the targeted position, and the surrounding area of the target. The computer moves the wands 708, 722. To move the water stream, to the targeted position. The computer is programmed, with bidet wand positioning software.

The bidet cleans the user's front and back position, using a stream of pressurized water sprayed, from nozzle water openings, in the cleaning wands. One cleaning wand 336 cleans the users back position, and the other wand 322 cleans the user's front position. Alternate bidet embodiments may use one wand to clean both front position and back elimination positions.

The computer moves the water stream nozzle 708, 720, to the viewed elimination positions. The computer calculates the water stream's trajectory from the nozzle, and moves the nozzle 308, 336 to the optimal cleaning position, before activating the water stream. The water sprays, streams on the position to be cleaned. The computer monitors, how close the water 346 is to either the front or back elimination positions. The computer with move the water stream to the optimal cleaning position, while the water is streaming, if the computer visually detects, the stream is away from the optimal position.

The water stream can be moved, to create differing patterns of water spray, being directed to the elimination position and area, and around the elimination position. Differing spray patterns may include an oscillating spray, a pulsating spray, a sweeping spray, a concentrated spray, and a dispersed spray, etc.

The user can override the automatic wash process and operate the bidet manually using the bidet control panel 342. The user may manually request the washing of the front and or back elimination position, the water aiming device.

The computer 440 instructs a motor controller, to move the bidet wand nozzle water stream 746, to the visually detected, user's front or back position. The camera 752 monitors the water stream, while it is washing the user, and adjusts the stream to stay on the targeted, front or back user position. The wand water streams 436, are directed out of openings 422, 432 in the bidet wand 420, 432. The water stream can follow the user's front and back elimination positions, cleaning positions if the user move.

An Automatic Water Stream Aiming Device, with an Automatic Bidet Using Operation The user eliminates, while occupying a toilet 816. The water aiming device positions the water stream nozzles, to stream water to the user's elimination positions. When the nozzles are in position to stream water on the user's elimination position, the pressurized water stream is activated. The user feels water being streamed to their elimination positions. The users doesn't need to move their body's elimination positions to the water stream. The water stream has been positioned at the elimination positions. The user's elimination position is washed with water from the water aiming device.

A user eliminates while sitting on the toilet seat 706. Before the start of the automatic bidets wash cycle the bidet's water stream nozzles 708, 722 move into a position to deliver a water spry to the user's elimination positions, without the user having to move their elimination positions, to the bidet's water stream 746. The bidet cleans the user's elimination positions.

Figure 8:
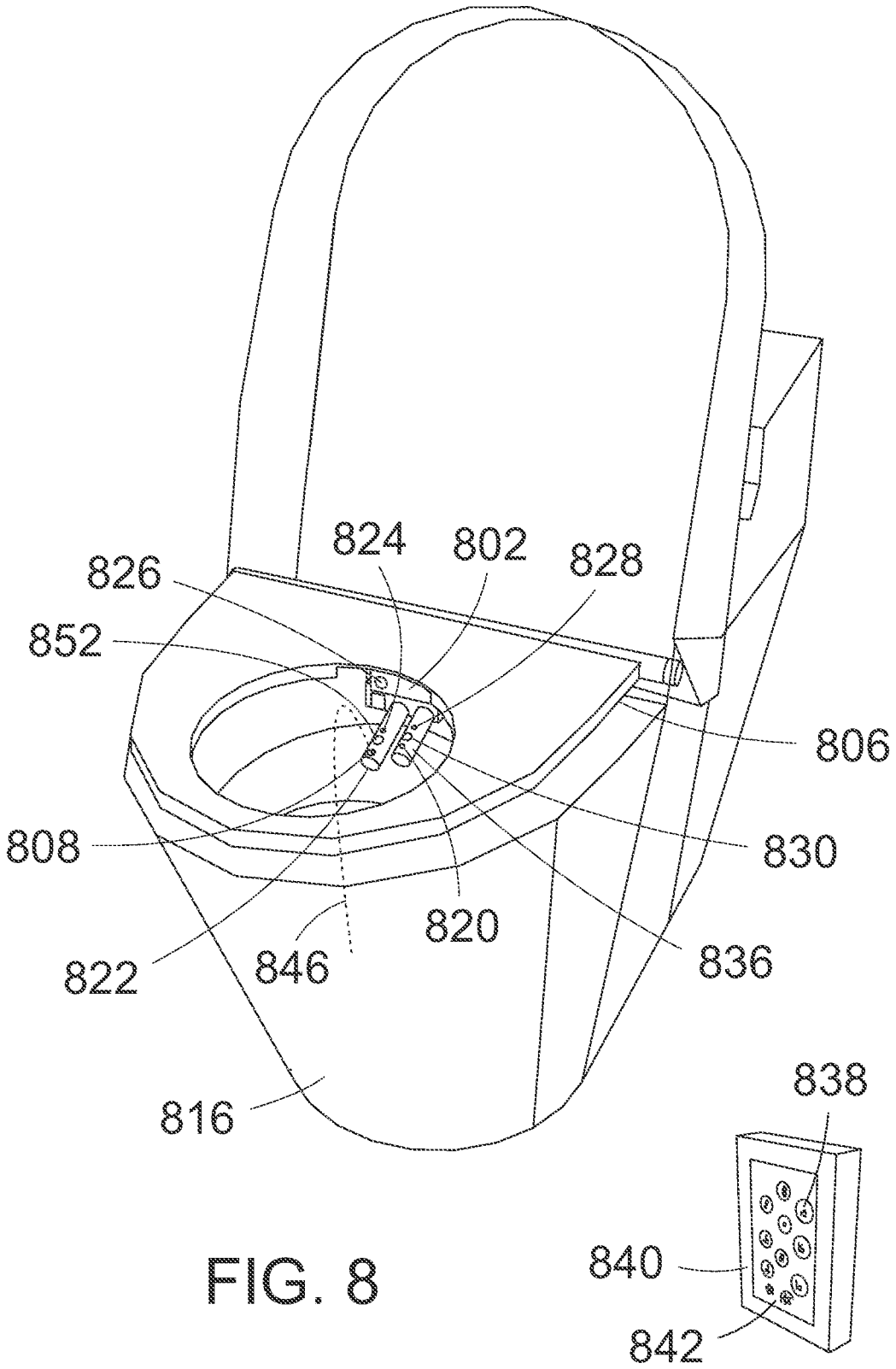
FIG. 8 shows a perspective view of an automatic air drying aiming device and an automatic water aiming device incorporated into an automatic bidet.

An Automatic Air Dryer Positioning Device Used with an Automatic Bidet Description and Operation Air is streamed out of an air nozzle 824, 828 or nozzles 824, 828 in the bidet wand, illustrated in FIG. 8. The streamed air dries the users elimination position. An automatic air stream aiming device, blow dryer, is used to target and direct, a stream of air to a user's, elimination positions. The elimination position dryers are incorporated into an automatic bidet.

The automatic air dyer can be used with a bidet automatic elimination water aiming device. The automatic air dyer can be used with an automatic bidet. The automatic air dyer can be used be used separately without the automatic elimination water aiming device.

The bidet 802 can be operated manually, using a remote bidet control panel 840, with the user inputting the bidet's operating settings on the remote display 842. The bidet can be operated, by touch activating displayed bidet operating function icons 838, with their finger. The bidet can be operated automatically, using the automatic bidet.

The air dyer uses the same elimination positioning system as the water aiming device, to direct a water drying stream of air, to the water, on the user's washed elimination position.

The air steaming nozzle is part of the bidet water streaming wand 822, 836. Each wand has one air drying nozzle. The air streaming nozzles wand is moved and positioned by a computer, in the bidet 802.

A camera and sensor view the user's elimination positions. The camera 852 and sensor 830 are connected to the computer. The camera and sensor detected elimination position information is used by the computer to direct the air to the user's washed elimination positions.

The computer 802 with elimination recognition software, uses images of the user's elimination positions to move the stream of air to one of more elimination positions. The computer records the elimination positions which are washed. The washed elimination positions are dried, after washing. The unwashed elimination positions are not dried.

If the user is sitting off center on the toilet seat 806, the wand 808, 836 or wands 808, 836 will move the air stream, to the users off center elimination positions. Users of different shapes and sizes may have differing elimination positions locations in the toilet bowel 816. The air dryer 824, 828 will move to the different elimination positions. A light 826 is used to illuminate the user's elimination positions, is attached to the bidet 802. The illumination of the eliminations positions improves the camera's imaging of the elimination positions.

The user eliminates while sitting on a toilet seat 806, illustrated in FIG. 8. A bidet's water stream 846 moves to the users bottom elimination positions, without the user having to move their elimination positions, to the bidet's water stream. The bidet cleans the user's elimination positions.

After the wash has finished, the elimination position air dryer nozzle in the wand moves the wand to direct a flow of air at the users washed elimination position. The computer identifies the user's elimination position, which to direct the flow of air on the elimination position. The elimination position air dryer can be used with the bottom air dryer. The bottom over dryer directs an air flow at the user's bottom. The clock displays a countdown, showing the duration of the air drying cycle, starting at 25 seconds. The bottom over dryer finishes when the clock counts down to 0 seconds. The bidet's air stream moves to the user's bottom cleaning positions without the user having to move to the air stream.

CONCLUSION, RAMIFICATION, AND SCOPE

Although the description above contains much specificity, these should not be construed as limiting the scope of the embodiments, but as merely providing illustrations, of some of the presently preferred embodiments. Additional embodiments may also include the preceding embodiments.

Deducing that the User is Female is Used in the Automatic Washing of a User Description and Operation If the user eliminates only from the front elimination position, it's assumed the user is female, since male users usually eliminate from their front position, standing at a urinal. The female front elimination position would be washed, with front only elimination. If from the front and back position elimination is detected, the back elimination position is washed first, a 20 second time period front the end of the back washing until the beginning of the front washing is used to give the male user time to vacate the toilet before the front washing starts. An ultrasonic sensor is connected to an automatic bidet computer. The ultrasonic sensor detects elimination from the position of elimination from the user's front or back. The automatic bidet uses the ultrasonic sensor data to automatically wash a user after elimination.

A Microphone is Used in the Automatic Washing of a User Description and Operation A Microphone is used the automatic washing of a user. The computer detects the start and stop of elimination. The user imaging device could also be and ultrasonic sensors, imaging sensors, imaging devices, an infrared camera, an air sonar sensor, and a laser imaging sensor LIDAR.

When the user stops eliminating, after 35 seconds to make sure the user has finished eliminating, the elimination position washing process starts. The female or males back elimination position is washed first. After the back elimination position is washed the front elimination position is washed. If the user doesn't want the front elimination position washed the user may stop the washing of the front elimination position by vacation the toilet. To allow a user to stop the front wash, there is a 15 second time period between the stopping of the back wash and the start of the front wash. When the user vacates the toilet, the bidet will automatically stop washing the user, and will also stop the washing cycle.

Genital Gender Recognition is Used in the Automatic Operation of a Bidet

A user's male or female gender is detected using a genital imaging device. A Microphone is used to automatically wash a user. The computer detects the start and stop of elimination, using data gather by a microphone inside a toilet bowel. The user elimination detecting microphone and genital imaging device could also be and ultrasonic sensors, imaging sensors, imaging devices, an infrared camera, an air sonar sensor, and a laser imaging sensor LIDAR, etc.

The female or males back elimination position is washed first. The females front elimination position is washed after the back position is washed. There's a 25 second delay before the front position is washed. The time delay allows the female user to vacate the toilet before the front position is washed. The male's front elimination position isn't washed. The toilet seat assembly may be made out of water resistant high strength plastic metal, rubber, and the like.

CONCLUSION

From the preceding description and drawings it becomes apparent that a user, may use the input of their sitting presence, and their use of the toilet, to operate the bidet devices, and to automatically wash the user, after using the toilet. The automatic bidet reduces the amount of bacteria that may be transferred to a user's hand, by reducing the need for the hand to operate the bidet. The user may operate the bidet devices, without having to use active input other than the use of the toilet to operate the bidet devices. The automatic bidet may automatically stream water, at a user's front and back elimination positions.

Thus the reader will see that at least one embodiment of the automatic bidet, automatic bidet water aiming device, provides a more reliable, healthier and economical device that can be used by persons of almost any age. It will be apparent that various changes and modifications can be made without departing from the scope of the various embodiments as defined in the claims.

Thus the scope of the embodiments should be determined by the appended claims and their legal equivalents rather than by the examples given.

I claim:

1. An automatic bidet, comprising:

a toilet;

a bidet for directing water at a user's posterior, vaginal area, or both while the user is in a sitting position on the toilet;

a gender sensor positioned to view the user for determining the gender of the user;

an elimination sensor for detecting urination, elimination, or both and for detecting the stopping of urination or elimination;

a computer configured to actuate said bidet based on information provided by said gender sensor and said elimination sensor whereby the user will have water directed at the posterior after eliminating, and if the user is female, have water directed at the vaginal area after urinating;

said computer having a clock which operates for a predetermined amount of clock operation time beginning upon detection of the stopping of urination and/or elimination;

whereby the automatic bidet operates upon expiration of said clock operation time as follows:

if elimination was detected, said computer actuates said bidet to direct water at a user's posterior, for a predetermined water time;

if urination was detected in combination with female gender detection, said computer actuates said bidet to direct water at the vaginal area, for a predetermined water time;

if urination and/or elimination is detected during clock operation time, said computer stops said clock operation.

2. The automatic bidet of claim 1, wherein the elimination sensor is a camera.

3. The automatic bidet of claim 1, wherein the gender sensor is a camera, and the gender sensor is positioned to view the user's genitals.

4. The automatic bidet of claim 1, further including a light connected to the computer, wherein the light is positioned to illuminate the posterior and vaginal area.

5. The automatic bidet of claim 1, further including a display connected to the computer, wherein the operation of the clock is shown on the display.

6. The automatic bidet of claim 1, further including an air dryer connected to the computer, wherein the air dryer is activated for a predetermined air dryer time when the predetermined water time has ended, and the air dryer is positioned to direct air at the posterior and vaginal area.

7. The automatic bidet of claim 1, wherein the computer is configured to stop the water directed at the posterior or vaginal area if urination and/or elimination is detected.

8. The automatic bidet of claim 1, further including an input display connected to the computer, wherein cleaning wait times are shown on the display, for the user's input into the cleaning wait times to change the predetermined amount of clock operation time.

9. The automatic bidet of claim 1, wherein the computer is configured to have the bidet direct water to locations of the posterior and vaginal area based on detected locations of the posterior and vaginal area provided by the elimination sensor.

10. The automatic bidet of claim 1, further including a user input display connected to the computer;

wherein a plurality of water temperatures are shown on the display for selection;

a user profile is stored in the computer;

the gender sensor is positioned to view the user's genitals;

the computer is configured to associate a view of the user's genitals with a selected water temperature and store the associated information in the user profile;

the computer is configured to visually recognize a user's genitals for activation of water temperature according to the user profile.

11. The automatic bidet of claim 2, wherein the camera is an infrared camera.

12. The automatic bidet of claim 3, wherein the camera is an infrared camera.

13. The automatic bidet of claim 1, wherein the elimination sensor is a microphone.

14. The automatic bidet of claim 1, wherein the gender sensor is a camera;

the gender sensor is positioned to view the user's face.

* * * * *